US011148422B2

(12) United States Patent
Miyagishi

(10) Patent No.: US 11,148,422 B2
(45) Date of Patent: Oct. 19, 2021

(54) LIQUID EJECTING HEAD AND LIQUID EJECTING APPARATUS

(71) Applicant: SEIKO EPSON CORPORATION, Tokyo (JP)

(72) Inventor: Akira Miyagishi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/576,888

(22) Filed: Sep. 20, 2019

(65) Prior Publication Data

US 2020/0094550 A1 Mar. 26, 2020

(30) Foreign Application Priority Data

Sep. 21, 2018 (JP) ..... JP2018-177071

(51) Int. Cl.

| | |
|---|---|
| ***B41J 2/14*** | (2006.01) |
| ***B41J 2/135*** | (2006.01) |
| ***B41J 2/045*** | (2006.01) |
| ***B41J 2/175*** | (2006.01) |

(52) U.S. Cl.

CPC ..... *B41J 2/1433* (2013.01); *B41J 2/0454* (2013.01); *B41J 2/135* (2013.01); *B41J 2/14274* (2013.01); *B41J 2/14314* (2013.01); *B41J 2/175* (2013.01); *B41J 2002/14306* (2013.01)

(58) Field of Classification Search

CPC . B41J 2/135; B41J 2/14; B41J 2/14201; B41J 2/14233; B41J 2/14314

See application file for complete search history.

(56) References Cited

U.S. PATENT DOCUMENTS

2012/0176450 A1 7/2012 Akahane et al.
2012/0182352 A1* 7/2012 Fukada ..... B41J 2/14274 347/54
2018/0257386 A1* 9/2018 Asaka ..... B41J 2/055

FOREIGN PATENT DOCUMENTS

JP 2012-143948 8/2012

* cited by examiner

*Primary Examiner* — Matthew Luu
*Assistant Examiner* — Kendrick X Liu
(74) *Attorney, Agent, or Firm* — Workman Nydegger

(57) ABSTRACT

A liquid ejecting head includes a flow passage member and an energy generating element. The flow passage member includes an individual flow passage including a nozzle and a pressure generating chamber communicating with the nozzle, a supply-side common flow passage, and a drain-side common flow passage. The energy generating element effects a pressure change in the liquid in the pressure generating chamber to discharge the liquid from the nozzle. The individual flow passage includes a supply-side individual flow passage between the supply-side common flow passage and the nozzle and a drain-side individual flow passage between the nozzle and the drain-side common flow passage. A second partition wall that separates a plurality of the drain-side individual flow passages from each other is thicker than a first partition wall that separates a plurality of the supply-side individual flow passages from each other.

6 Claims, 15 Drawing Sheets

LIQUID EJECTING HEAD AND LIQUID EJECTING APPARATUS

The present application is based on, and claims priority from JP Application Serial Number 2018-177071, filed Sep. 21, 2018, the disclosure of which is hereby incorporated by reference herein in its entirety.

BACKGROUND

1. Technical Field

The present disclosure relates to liquid ejecting heads and liquid ejecting apparatuses that eject liquid from nozzles and, in particular, to an ink jet recording head and an ink jet recording apparatus that discharge ink as liquid.

2. Related Art

A known example of a liquid ejecting head that ejects liquid is an ink jet recording head that discharges ink as liquid from nozzles.

An ink jet recording head includes pressure generating chambers that communicate with nozzles and energy generating elements, such as piezoelectric actuators, that effect pressure changes in ink in the pressure generating chambers. The ink jet recording head discharges ink from the nozzles by using the energy generating elements to effect pressure changes in the ink in the pressure generating chambers.

Further, thickening of the ink by the nozzles and sedimentation of a component contained in the ink cause variations in discharge property of ink droplets, i.e. weight and discharge rate of ink droplets, undesirably causing variations in landing.

Given these circumstances, there has been proposed an ink jet recording head configured to circulate ink of pressure generating chambers (see, for example, JP-A-2012-143984).

However, partition walls of individual flow passages on a drain-side are so thin that depending on the presence or absence of driving of adjacent energy generating elements, i.e. the presence or absence of pressure changes in adjacent pressure generating chambers, the partition walls of the individual flow passages on the drain-side flexurally deform to cause variations in weight of ink droplets. This problem is so-called "structural crosstalk". In particular, as nozzles are becoming denser, the placement of the individual flow passages on the drain-side is becoming denser. Accordingly, the partition walls are becoming thinner, so that the rigidity of the partition walls decreases. This undesirably makes structural crosstalk tend to take place.

Further, increases in path length of the individual flow passages on the drain-side lead to decreases in rigidity of the partition walls, and increases in flow passage cross-sectional area of individual flow passages on the drain-side whose paths are long lead to decreases in rigidity of the partition walls. This undesirably makes structural crosstalk tend to take place.

Such a problem is present not only in an ink jet recording head, but also in a liquid ejecting head that ejects liquid other than ink.

SUMMARY

In view of this, the present disclosure has as an object to provide a liquid ejecting head and a liquid ejecting apparatus with reduced variations in discharge property with suppressed crosstalk of partition walls of drain-side individual flow passages.

According to an aspect of the present disclosure, there is provided a liquid ejecting head including a flow passage member and an energy generating element. The flow passage member includes an individual flow passage including a nozzle that discharges liquid and a pressure generating chamber that communicates with the nozzle, a supply-side common flow passage through which to supply the liquid to a plurality of the individual flow passages, and a drain-side common flow passage through which to drain the liquid from a plurality of the individual flow passages. The energy generating element effects a pressure change in the liquid in the pressure generating chamber to discharge the liquid from the nozzle. The individual flow passage includes a supply-side individual flow passage between the supply-side common flow passage and the nozzle and a drain-side individual flow passage between the nozzle and the drain-side common flow passage. A second partition wall that separates a plurality of the drain-side individual flow passages from each other is thicker than a first partition wall that separates a plurality of the supply-side individual flow passages from each other.

Further, according to another aspect of the present disclosure, there is provided a liquid ejecting head including a flow passage member and an energy generating element. The flow passage member includes an individual flow passage including a nozzle that discharges liquid and a pressure generating chamber, a supply-side common flow passage through which to supply the liquid to a plurality of the individual flow passages, and a drain-side common flow passage through which to drain the liquid from a plurality of the individual flow passages. The energy generating element effects a pressure change in the liquid in the pressure generating chamber to discharge the liquid from the nozzle. The individual flow passage includes a supply-side individual flow passage between the supply-side common flow passage and the nozzle and a drain-side individual flow passage between the nozzle and the drain-side common flow passage. A plurality of the nozzles are arranged on a nozzle surface. A plurality of the drain-side individual flow passages include flow passages that are different in distance from the nozzle surface in a direction orthogonal to the nozzle surface.

Further, according to another aspect of the present disclosure, there is provided a liquid ejecting head including a flow passage member and an energy generating element. The flow passage member includes an individual flow passage including a nozzle that discharges liquid and a pressure generating chamber, a supply-side common flow passage through which to supply the liquid to a plurality of the individual flow passages, and a drain-side common flow passage through which to drain the liquid from a plurality of the individual flow passages. The energy generating element effects a pressure change in the liquid in the pressure generating chamber to discharge the liquid from the nozzle. The individual flow passage includes a supply-side individual flow passage between the supply-side common flow passage and the nozzle and a drain-side individual flow passage between the nozzle and the drain-side common flow passage. A plurality of the drain-side individual flow passages include flow passages that are different in orientation from the nozzle in an in-plane direction of a nozzle surface on which a plurality of the nozzles are arranged.

Furthermore, according to another aspect of the present disclosure, there is provided a liquid ejecting apparatus including the liquid ejecting head according to the aspect described above.

DESCRIPTION OF EXEMPLARY EMBODIMENTS

The present disclosure is described in detail below with reference to embodiments.

Embodiment 1

Figure 1:
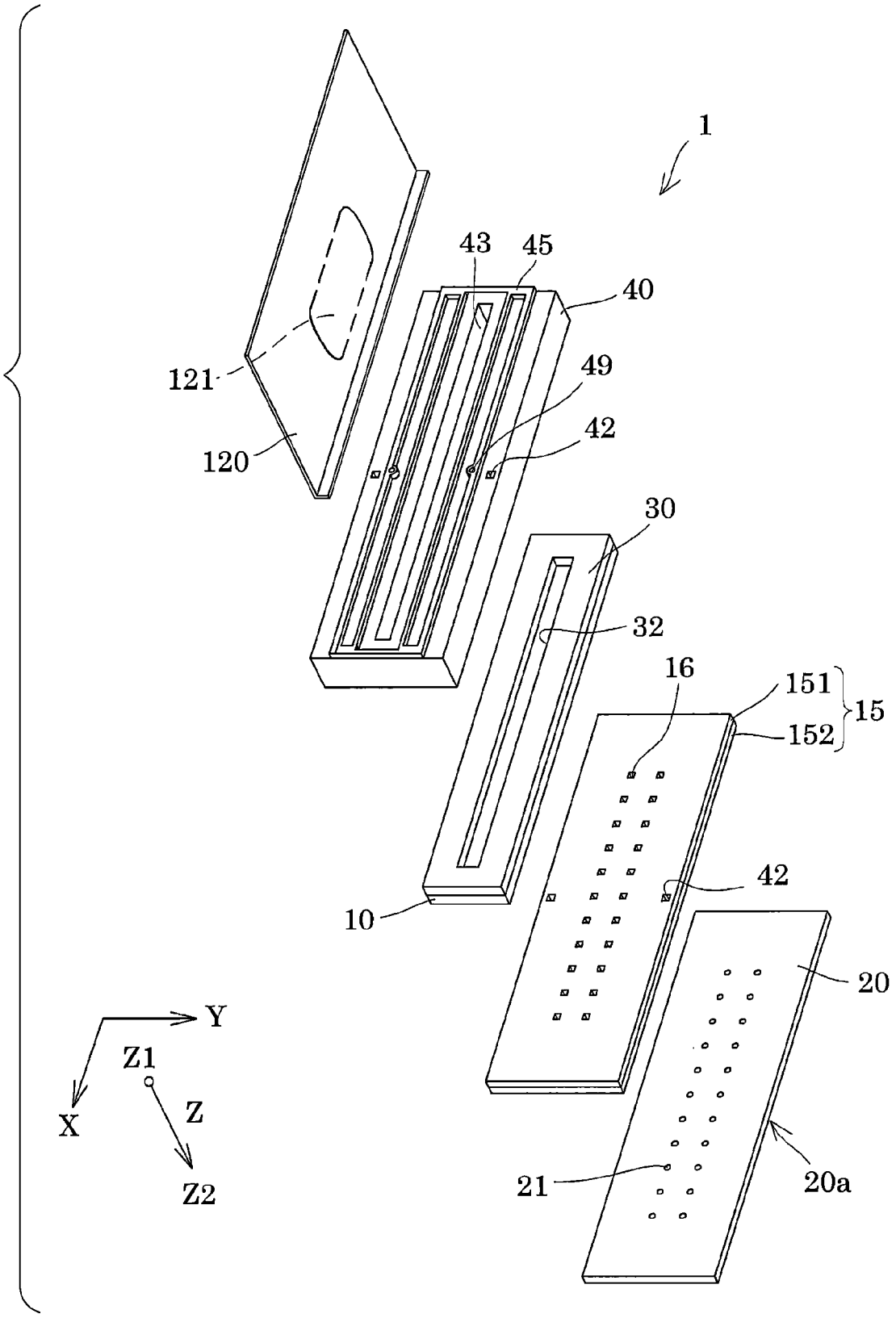
FIG. 1 is an exploded perspective view of a recording head according to Embodiment 1.
Figure 2:
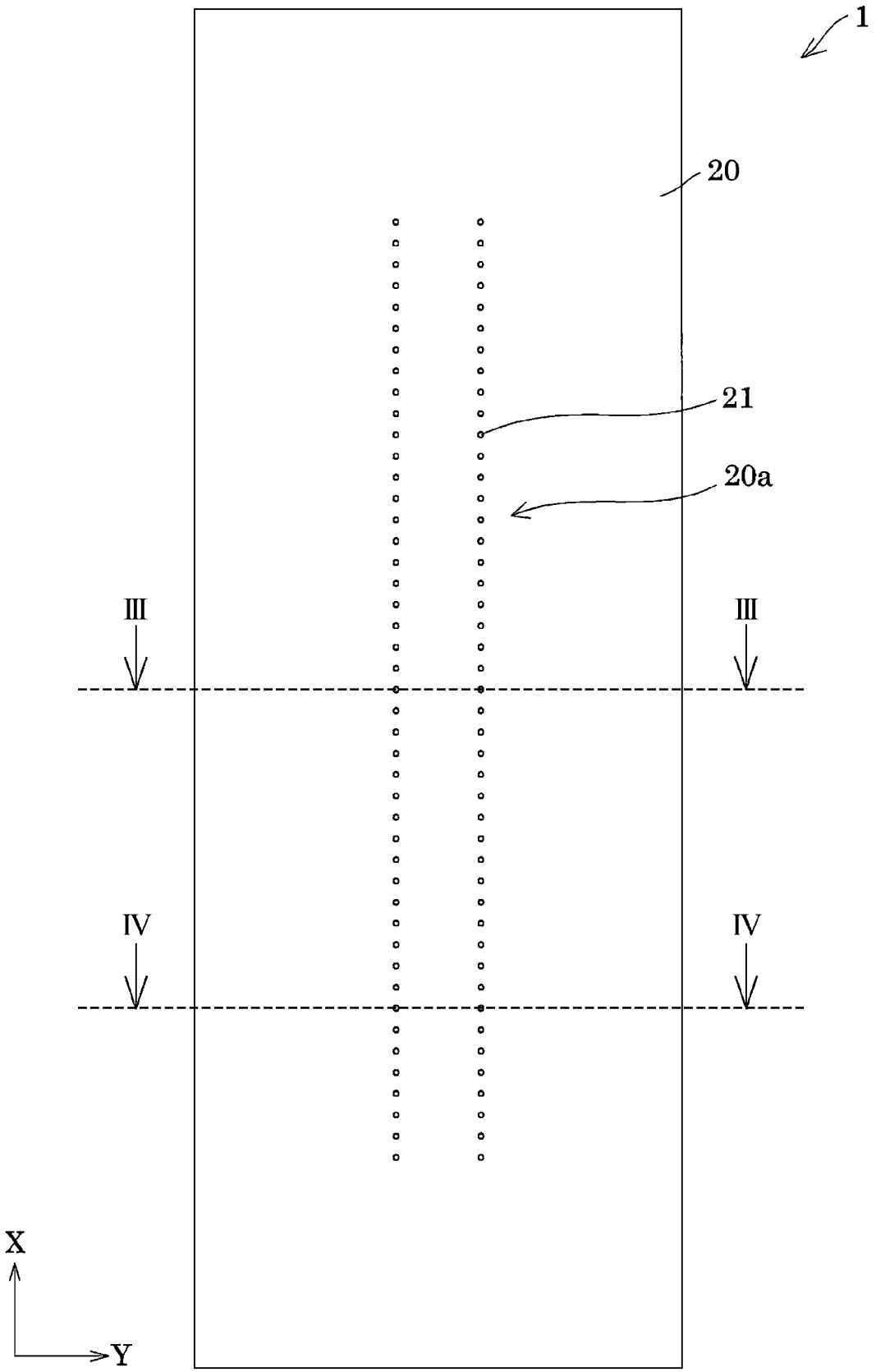
FIG. 2 is a plan view of the recording head according to Embodiment 1.
Figure 3:
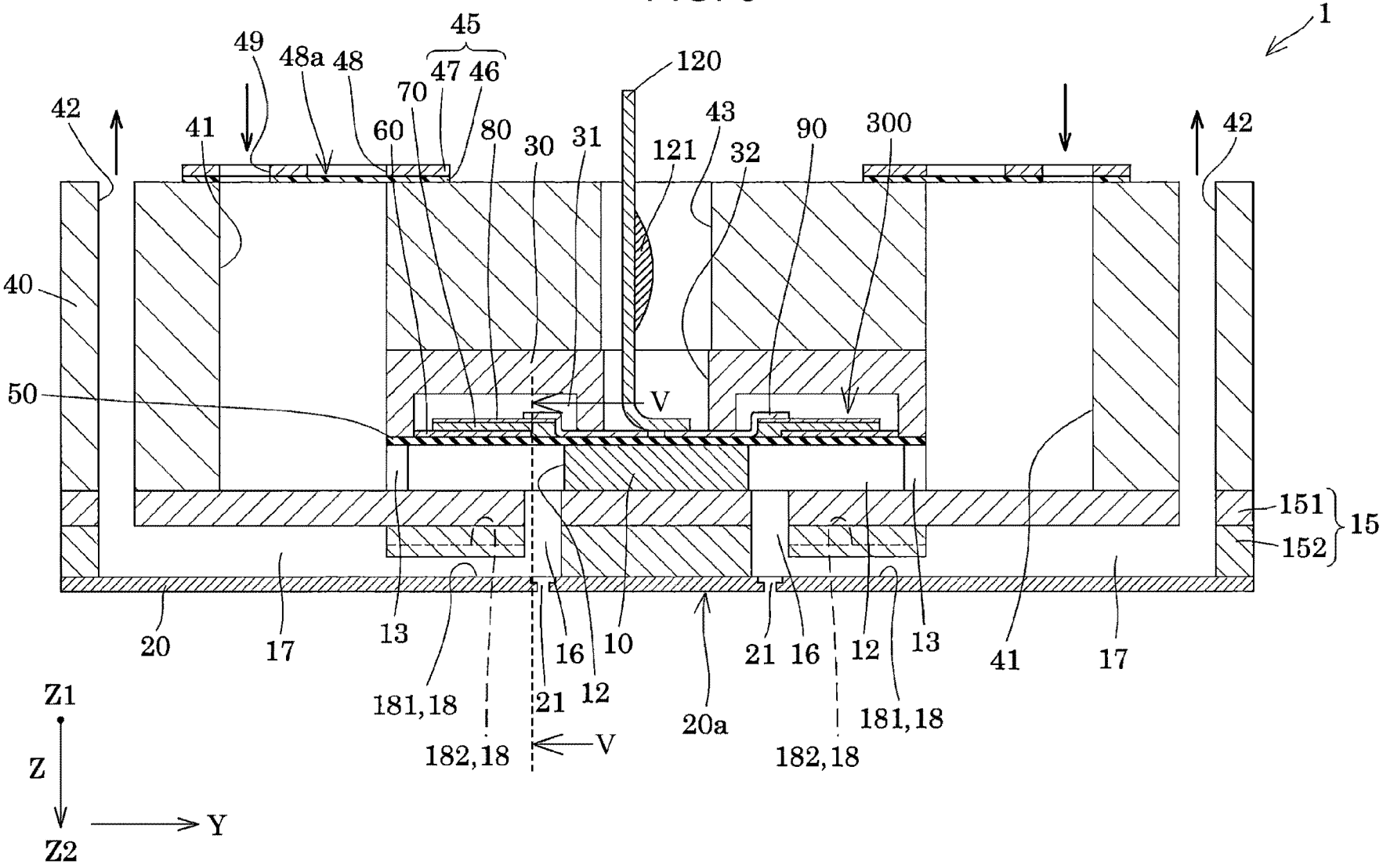
FIG. 3 is a cross-sectional view of the recording head according to Embodiment 1.
Figure 4:
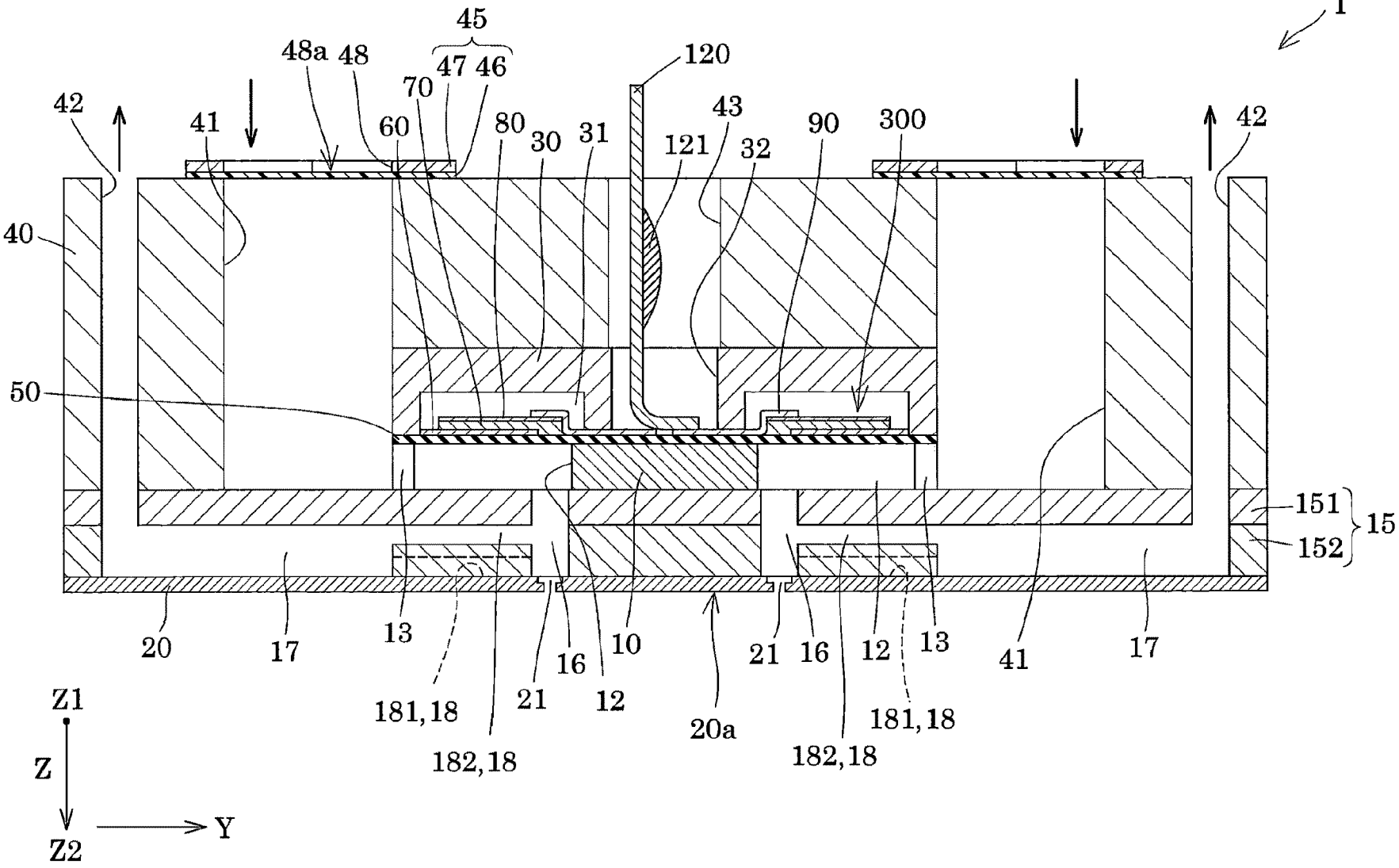
FIG. 4 is a cross-sectional view of the recording head according to Embodiment 1.
Figure 5:
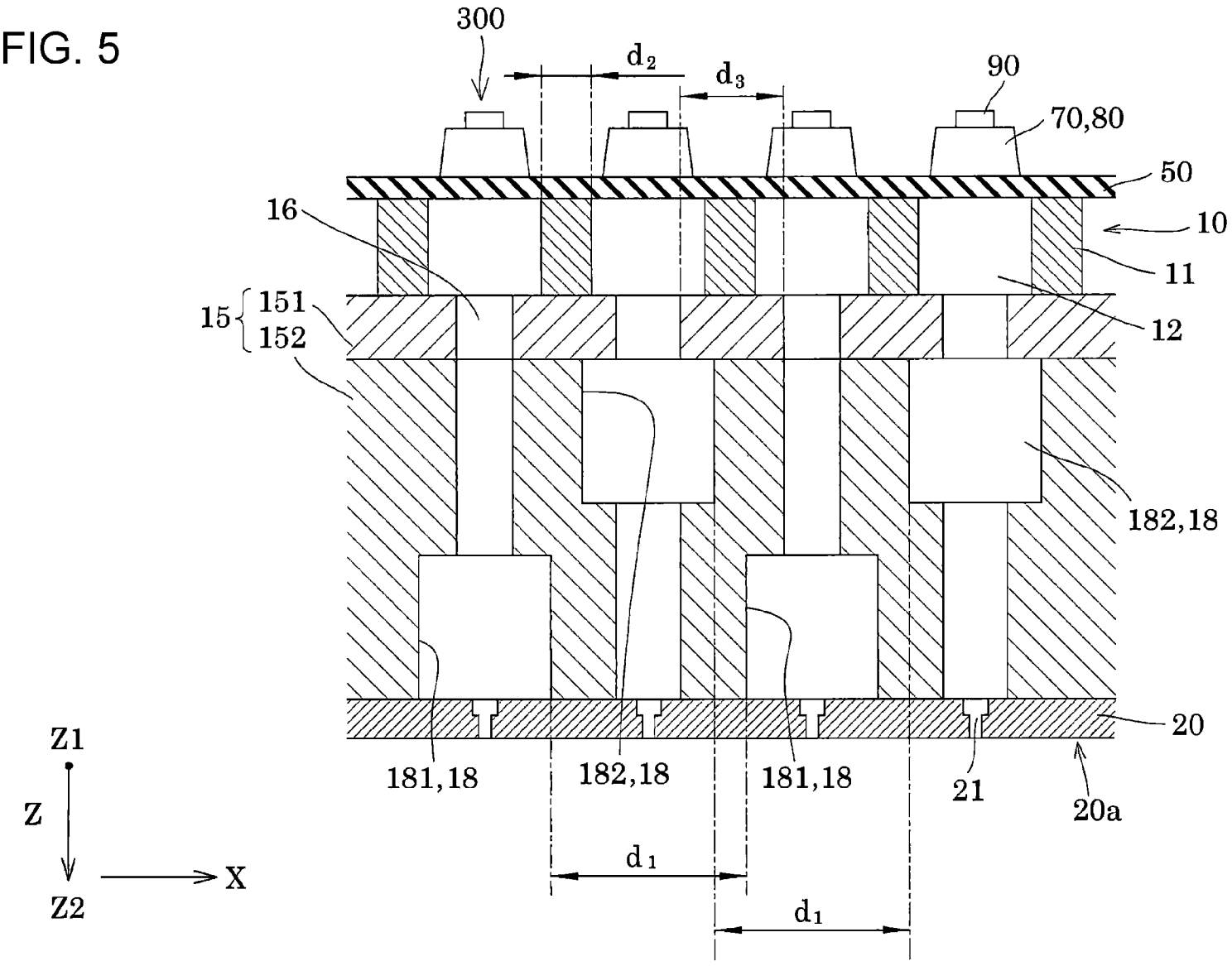
FIG. 5 is a cross-sectional view of the recording head according to Embodiment 1.

FIG. 1 is an exploded perspective view of an ink jet recording head that is an example of a liquid ejecting head according to Embodiment 1 of the present disclosure. FIG. 2 is a plan view of the ink jet recording head from the nozzle-surface side. FIG. 3 is a cross-sectional view taken along line in FIG. 2. FIG. 4 is a cross-sectional view taken along line IV-IV in FIG. 2, and FIG. 5 is a cross-sectional view taken along line V-V in FIG. 3.

As illustrated, an ink jet recording head 1 (hereinafter also simply referred to as "recording head 1"), which is an example of a liquid ejecting head according to the present embodiment, includes a plurality of members such as a flow passage forming substrate 10, a communicating plate 15, a nozzle plate 20, a protective substrate 30, a case member 40, and a compliance substrate 45 as a flow passage member.

The flow passage forming substrate 10 is constituted by a silicon single crystal substrate and has a vibrating plate 50 formed on one surface thereof. The vibration plate 50 may be a monolayer or laminate selected from among a silicon dioxide layer and a zirconium dioxide layer.

The flow passage forming substrate 10 has pressure generating chambers 12 divided from one another by a plurality of partition walls 11 and placed side by side along a direction in which a plurality of nozzles 21 that discharge ink are placed side by side. This direction is hereinafter referred to as "direction of side-by-side placement of the pressure generating chambers 12" or "first direction X". Further, the flow passage forming substrate 10 has multiple rows of pressure generating chambers 12 placed side by side in the first direction X. In the present embodiment, the flow passage forming substrate 10 has two rows of pressure generating chambers 12 placed side by side in the first direction X. These multiple rows of pressure generating chambers 12 are arranged parallel to each other in a direction that is hereinafter referred to as "second direction Y". In the present embodiment, parts of the flow passage forming substrate 10 between the pressure generating chambers 12 placed side by side in the first direction X are referred to as "partition walls 11". These partition walls 11 extend along the second direction Y. That is, the partition walls 11 are parts of the flow passage forming substrate 10 that overlap the pressure generating chambers 12 in the second direction Y.

Furthermore, a direction orthogonal to both the first direction X and the second direction X is referred to as "third direction Z". More specifically, the third direction Z has a Z1 side that points toward the case member 40, which will be described later, and a Z2 side that points toward the nozzle plate 20. Although the first direction X, the second direction Y, and the third direction Z have been described as directions orthogonal to one another, this is not intended to impose any particular limitation. The first direction X, the second direction Y, and the third direction Z may be directions that cross one another at non-right angles.

Further, the flow passage forming substrate 10 has an ink supply passage 13 provided at one end of each pressure generating chamber 12 in the second direction Y. The ink supply passage 13 is narrower in opening area than the pressure generating chamber 12. The ink supply passage 13 imparts flow passage resistance to ink that flows into the pressure generating chamber 12. In the present embodiment, the ink supply passage 13 is formed to be narrower in width than the pressure generating chamber 12 in the first direction X. Instead of being configured to be narrower in width, the ink supply passage 13 may be made narrower in height in the third direction Z.

As mentioned above, the vibrating plate 50 is formed on the Z side, which is a side of the third direction Z that points toward one position, of such a flow passage forming substrate 10. Over this vibrating plate 50, a first electrode 60, a piezoelectric body layer 70, and a second electrode 80 are stacked by deposition and lithography techniques to constitute a piezoelectric actuator 300. In the present embodiment, the piezoelectric actuator 300 serves as an energy element that effects a pressure change in ink in a pressure generating chamber 12. The piezoelectric actuator 300 is also referred to as "piezoelectric element" and refers to a part including the first electrode 60, the piezoelectric body layer 70, and the second electrode 80. In general, either of the electrodes of the piezoelectric actuator 300 serves as a common electrode, and the other electrode and the piezoelectric body layer 70 are configured by patterning for each pressure generating chamber 12. In the present embodiment, the first electrode 60 serves as a common electrode of the piezoelectric actuator 300, and the second electrode 80 serves as an individual electrode of the piezoelectric actuator 300. However, for convenience of a drive circuit and wires, this may be reversed without problem. Although, in the aforementioned example, the vibrating plate 50 and the first electrode 60 function as a vibrating plate, this is of course not intended to impose any limitation. For example, only the first electrode 60 may function as a vibrating plate without the vibrating plate 50 being provided. Alternatively, the piezoelectric actuator 300 per se may also substantially serve as a vibrating plate.

Further, each of such piezoelectric actuators 300 has its second electrode 80 connected to a lead electrode 90 via which a voltage is selectively applied to the piezoelectric actuator 300.

Further, the protective substrate 30 is joined to a surface of the flow passage forming substrate 10 that faces the piezoelectric actuators 300.

The protective substrate 30 has a piezoelectric actuator retainer 31 provided in a region of the protective substrate 30 that faces a piezoelectric actuators 300. The piezoelectric actuator retainer 31 has such a space as not to inhibit movement of the piezoelectric actuators 300. The piezoelectric actuator retainer 31 needs only have such a space as not to inhibit movement of the piezoelectric actuators 300, and this space may be enclosed or may not be enclosed.

Such a protective substrate 30 may be made of a material that is substantially equal in coefficient of thermal expansion to the flow passage forming substrate 10. Examples of the material include glass and ceramic materials. In the present embodiment, the protective substrate 30 is formed by a silicon single crystal substrate made of the same material as the flow passage forming substrate 10.

Further, the protective substrate 30 is provided with a through hole 32 bored through the protective substrate 30 in the third direction Z. Moreover, the vicinity of an end of the lead electrode 90 drawn out from each piezoelectric actuator 300 is extended to be exposed into the through hole 32, and is electrically connected to a flexible cable 120 inside the through hole 32. The flexible cable 120 is a flexible wiring substrate and, in the present embodiment, is mounted with a drive circuit 121 that is a semiconductor element.

Further, the case member 40 is fixed on the protective substrate 30. Together with the protective substrate 30, the case member 40 defines a supply-side common flow passage that communicates with a plurality of the pressure generating chambers 12. The case member 40 is not only joined to a surface of the protective substrate 30 opposite to the flow passage forming substrate 10 but also joined to the communicating plate 15, which will be described later.

Such a case member 40 is provided with a supply-side common flow passage 41. In the present embodiment, the supply-side common flow passage 41 is bored through the case member 40 in the third direction Z and continuously provided across pressure generating chambers 12 placed side by side in the first direction X. An opening of such a supply-side common flow passage 41 that faces toward the nozzle plate 20 is sealed with the communicating plate 15. Further, the supply-side common flow passage 41 has its walls partially defined by the flow passage forming substrate 10 and the protective substrate 30. Moreover, the supply-side common flow passage 41 communicates with the plurality of power generating chambers 12 in common through the ink supply passages 13 of the flow passage forming substrate 10.

The case member 40 has such supply-side common flow passages 41 provided on both sides of the second direction Y with respect to the two rows of pressure generating chambers 12, respectively, so that each row of pressure generating chambers 12 communicates with an outside common supply-side common flow passage 41.

Further, the term "supply-side common flow passage 41" refers to a flow passage directly branches off into supply-side individual flow passages and, for example, a flow passage that causes liquid to branch off into a plurality of supply-side common flow passages is not encompassed. That is, in the present embodiment, the case member 40 is provided with two supply-side common flow passages 41, and for example, when the two supply-side common flow passages 41 are supplied with the same ink, a flow passage that causes the ink to branch off into the two supply-side common flow passages 41 upstream from the case member 40 is not encompassed, although not particularly illustrated.

Further, the compliance substrate 45 is provided on a surface of the case member 40 bored through by the supply-side common flow passages 41 opposite to the protective substrate 30 in the third direction Z. In the present embodiment, the compliance substrate 45 includes a sealing film 46 constituted by a flexible thin film and a fixing substrate 47 made of a hard material such as metal. Since regions of the fixing substrate 47 that correspond to the supply-side common flow passages 41 serves as openings 48 from which the fixing substrate 47 has been completely removed in a thickness direction, one surface of each of the supply-side common flow passages 41 serves as a flexible portion **48*a* sealed with the flexible sealing film 46 alone. The compliance substrate 45 absorbs a pressure change in ink in the supply-side common flow passage 41 due to bending of the flexible portion 48*a***.

Further, the compliance substrate 45 is provided with ink inlets 49 bored therethrough in the third direction Z, and ink is supplied to the supply-side common flow passages 41 through the ink inlets 49 from an external ink supply unit (not illustrated).

Further, the case member 40 is provided with a connection slot 43 that communicates with the through hole 32 of the protective substrate 30 and through which the flexible cable 120 is inserted.

Meanwhile, the communicating plate 15 and the nozzle plate 20 are stacked in sequence on the Z2 side of the flow passage forming substrate 10 opposite to the protective substrate 30.

In the present embodiment, the communicating plate 15 is constituted by a first communicating plate 151 and a second communicating plate 152 being stacked in the third direction Z. The first communicating plate 151 is provided beside the flow passage forming substrate 10, i.e. toward the Z1 side of the third direction Z, and the second communicating plate 152 is provided beside the nozzle plate 20, i.e. toward the Z2 side of the third direction Z.

Such a communicating plate 15 is provided with nozzle communicating passages 16 serving as communicating passages through which the pressure generating chambers 12 and the nozzles 21 communicate with each other. The nozzle communicating passages 16 are bored through the first communicating plate 151 and the second communicating plate 152 in the third direction Z.

The nozzle plate 20 is provided with the nozzles 21, which communicate with the pressure generating chambers 12 through the nozzle communicating passages 16, respectively. Those ones of the nozzles 21 which discharge the same type of liquid (e.g. ink) are placed side by side in the first direction X, and two of these rows of nozzles 21 placed side by side in the first direction X are arranged parallel to each other in the second direction Y (see FIG. 2).

In the present embodiment, supply-side individual flow passages between the supply-side common flow passages 41 and the nozzles 21 include the ink supply passages 13, the pressure generating chambers 12, and the nozzle communicating passages 16.

Further, the communicating plate 15 is provided with a drain-side common flow passage 17. The drain-side common flow passage 17 is bored through the second communicating plate 152 in the third direction Z and continuously provided across the pressure generating chambers 12 placed side by side in the first direction X. An opening of the drain-side common flow passage 17 that faces toward the Z1 side of the third direction Z is sealed with the first communicating plate 151. Further, an opening of the drain-side common flow passage 17 that faces toward the Z2 side of the third direction Z is sealed with the nozzle plate 20. In the present embodiment, such a drain-side common flow passage 17 is disposed in such a position as to at least partially overlap the supply-side common flow passages 41 when seen in plan view from the third direction Z and is separated from the supply-side common flow passages 41 by the first communicating plate 151. Further, ends of the drain-side common flow passage 17 opposite to the pressure generating chambers 12 in the second direction Y are extended further outward than the supply-side common flow passages 41. Connected to these ends of the drain-side common flow passage 17 extended further outward than the supply-side common flow passages 41 are first ends of drain passages 42 provided across the first communicating plate 151 and the case member 40. Second ends of the drain passages 42 are provided as openings in a surface of the case member 40 opposite to the communicating plate 15 that face toward the Z1 side of the third direction Z, and ink in the drain-side common flow passage 17 is drained out of the recording head 1 from a surface of the case member 40 opposite to a nozzle surface 20*a* in the third direction Z through the drain passages 42. The ink drained out of the recording head 1 through the drain passages 42 may be returned to the ink supply unit, which supplies ink to the recording head 1, to circulate between the ink supply unit and the recording head 1 or may be drained into a part other than the ink supply unit, for example, to be disposed of.

Provided between such a drain-side common flow passage 17 and the nozzles 21 are drain-side individual flow passages 18. In the present embodiment, each of the drain-side individual flow passages 18 has a first end communicating with a corresponding one of the nozzle communicating passages 16 and a second end open toward the drain-side common flow passage 17 so that the nozzle communicating passage 16 and the drain-side common flow passage 17 communicates with each other through the drain-side individual flow passage 18. That is, the present embodiment has the supply-side individual flow passages and the drain-side individual flow passages 18 as individual flow passages between the supply-side common flow passages 41 and the drain-side common flow passage 17.

The present embodiment provides each of the nozzles 21 with one of these drain-side individual flow passages 18, which include first drain-side individual flow passages 181 and second drain-side individual flow passages 182 that are different in distance from the nozzle surface 20*a* in the third direction Z, which is a direction perpendicular to the nozzle surface 20*a*. In the present embodiment, those ones of the drain-side individual flow passages 18 which are close to the nozzle surface 20*a* and whose distance from the nozzle surface 20*a* is a first distance are referred to as "first drain-side individual flow passages 181", and those ones of the drain-side individual flow passages 18 whose distance from the nozzle surface 20*a* is a second distance that is longer than the first distance are referred to as "second drain-side individual flow passages 182".

As illustrated in FIGS. 3 and 5, the first drain-side individual flow passages 181 are formed at the joint interface between the second communicating plate 152 and the nozzle plate 20 by covering, with the nozzle plate 20, recesses bored in a surface the second communicating plate 152 that faces the nozzle plate 20.

As illustrated in FIGS. 4 and 5, the second drain-side individual flow passages 182 are provided at the joint interface between the first communicating plate 151 and the second communicating plate 152 by covering, with the first communicating plate 151, recesses bored in a surface of the second communicating plate 152 that faces the first communicating plate 151.

Further, those ones of the first and second drain-side individual flow passages 181 and 182 which communicate with a row of nozzles 21 placed side by side in the first direction X are arranged in the same orientation from the nozzles 21 in in-plane directions of the nozzle surface 20*a*, i.e. in-plane directions including the first direction X and the second direction Y. That is, those ones of the first drain-side individual flow passages 181 and second drain-side individual flow passages 182 which communicate with one of the rows of nozzles 21 are extended toward a side opposite to the first drain-side individual flow passages 181 and second drain-side individual flow passages 182 of the other row of nozzles 21 along the second direction Y. For this reason, those ones of the first drain-side individual flow passages 181 and second drain-side individual flow passages 182 which communicate with a row of nozzles 21 placed side by side in the first direction X are provided in communication with the same drain-side common flow passage 17.

In the present embodiment, the first drain-side individual flow passages 181 and the second drain-side individual flow passages 182 are formed to be equal in flow passage cross-sectional shape and flow passage cross-sectional area to each other. This makes it possible to reduce the occurrence of variations in discharge property of ink droplets by attaining uniform flow passage resistance by making the plurality of drain-side individual flow passages 18 equal in flow passage cross-sectional area and path length to one another. The first drain-side individual flow passages 181 and the second drain-side individual flow passages 182 are formed to be greater in width than the nozzle communicating passages 16 in the first direction X. Further, in the present embodiment, the first drain-side individual flow passages 181 and the second drain-side individual flow passages 182 are smaller in width in a direction of flow of ink through the drain-side individual flow passages 18, i.e. the first direction X, which is a direction of side-by-side placement of the nozzle communicating passages 16, as seen from the second direction Y, than in height in the third direction Z of flow of ink through the nozzle communicating passages 16. By thus making the drain-side individual flow passages 18 smaller in width in the first direction X than in height in the third direction Z, the thicknesses of second partition walls that separate the plurality of drain-side individual flow passages 18 from one another are made greater and increases in flow passage resistance of the drain-side individual flow passages 18 are suppressed, so that defects in drainage of ink and defects in discharge of ink droplets due to increases in flow passage resistance can be reduced.

Of course, the drain-side individual flow passages 18 may be larger in width in the first direction X than in height in the third direction Z.

As illustrated in FIG. 5, the first and second drain-side individual flow passages 181 and 182 that communicate with the same row of nozzles 21 and that are at short and long distances, respectively, from the nozzle surface 20*a* are repeatedly arranged in the first direction X in which the drain-side individual flow passages 18 are placed side by side. In the present embodiment, the first drain-side individual flow passages 181 and the second drain-side individual flow passages 182 are alternately arranged one by one in the first direction X. It should be noted that the repeated arrangement of the first drain-side individual flow passages 181 and the second drain-side individual flow passages 182 in the first direction X encompasses an alternate arrangement of two or more of these first drain-side individual flow passages 181 and two or more of these second drain-side individual flow passages 182, i.e. an alternate arrangement of a first group of two or more first drain-side individual flow passages 181 successively placed side by side and a second group of two or more second drain-side individual flow passages 182 successively placed side by side.

In this way, drain-side individual flow passages 18 communicating with the same row of nozzles 21 are constituted by first drain-side individual flow passages 181 and second drain-side individual flow passages 182 that are different in distance from the nozzle surface 20*a* and the first drain-side individual flow passages 181 and the second drain-side individual flow passages 182 are alternately and repeatedly arranged one by one in the first direction X, whereby the second partition walls that separate the drain-side individual flow passages 18 from one another can be made thicker than first partition walls that separate the supply-side individual flow passages from one another.

The second partition walls here refer to partition walls that separate drain-side individual flow passages 18 adjacent to one another in the first direction X from one another and also refer to parts that overlap the drain-side individual flow passages 18 in the first direction X. That is, in the present embodiment, in which the first drain-side individual flow passages 181 and the second drain-side individual flow passages 182 are alternately and repeatedly arranged one by one in the first direction X, the second partition walls refer to a part between two first drain-side individual flow passages 181 adjacent to each other in the first direction X and a part between two second drain-side individual flow passages 182 adjacent to each other in the first direction X.

Further, the first partition walls, whose thicknesses are compared with those ones of the second partition walls and which separate the supply-side individual flow passages from one another, refer to the thinnest ones of those partition walls which separate the supply-side individual flow passages from one another. In the present embodiment, whose supply-side individual flow passages are the ink supply passages 13, the pressure generating chambers 12, and the nozzle communicating passages 16, examples of the first partition walls include partition walls that separate the plurality of ink supply passages 13 from one another in the first direction X, the partition walls 11, which separate the plurality of pressure generating chambers 12 from one another in the first direction X, and partition walls that separate the plurality of nozzle communicating passages 16 from one another in the first direction X. In the present embodiment, whose ink supply passages 13 are formed by making the pressure generating chambers 12 narrower in width in the first direction X, the partition walls 11, which separate the pressure generating chambers 12 from one another, are thinner than the partition walls that separate the ink supply passages 13 from one another. Further, in the present embodiment, in which the nozzle communicating passages 16 are smaller in width in the first direction X than the pressure generating chamber 12, the partition walls 11, which separate the pressure generating chambers 12 from one another, are thinner than the partition walls that separate the nozzle communicating passages 16 from one another. Accordingly, in the present embodiment, the thinnest partition walls of the first partition walls are the partition walls 11, which separate the pressure generating chambers 12 from one another in the first direction X.

Moreover, in the present embodiment, the first drain-side individual flow passages 181 and the second drain-side individual flow passages 182, which are different in distance from the nozzle surface 20*a*, are alternately and repeatedly arranged one by one in the first direction X, whereby the thickness $d_1$ of each of the second partition walls that separate the drain-side individual flow passages 18 from one another in the first direction X is greater than the thickness $d_2$ of each of the partition walls 11 serving as the first partition walls that separate the pressure generating chambers 12 from one another, i.e. $d_1>d_2$. Further, in the present embodiment, the first drain-side individual flow passages 181 and the second drain-side individual flow passages 182 are alternately and repeatedly arranged one by one in the first direction X, whereby the thickness $d_1$ of each of the second partition walls that separate the drain-side individual flow passages 18 from one another in the first direction X is greater than the thickness $d_3$ of each of the first partition walls that separate the nozzle communicating passages 16 from one another, i.e. $d_1>d_3$.

Figure 6:
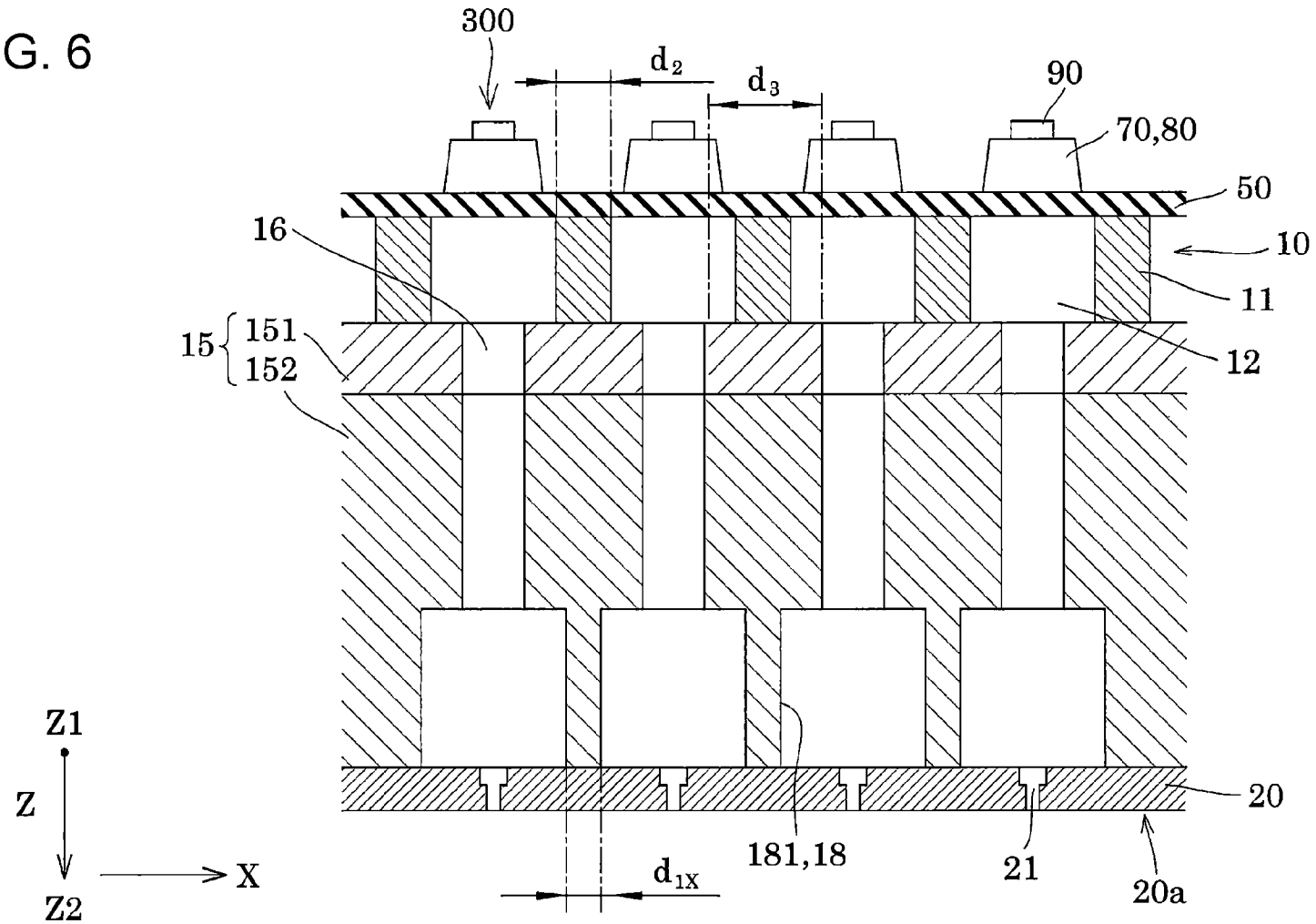
FIG. 6 is a cross-sectional view of a recording head according to a comparative example.

Incidentally, as illustrated in FIG. 6, when all of the drain-side individual flow passages 18 are placed at the same distance from the nozzle surface 20*a*, i.e. when only the first drain-side individual flow passages 181 are provided as the drain-side individual flow passages 18, the thickness $d_1$, of each of the second partition walls that separate the drain-side individual flow passages 18 from one another in the second direction Y is smaller than the thickness $d_1$ of each of the second partition walls illustrated in FIG. 5. Such a decrease in rigidity of a second partition wall due to thinness leads to decreases in discharge property, i.e. weight and discharge rate, of ink droplets, because when a pressure change occurs in a first one of adjacent pressure generating chambers 12 and no pressure change occurs in a second one of the pressure generating chambers 12, the pressure change in the first pressure generating chamber 12 causes the second partition wall to flexurally deform to absorb the pressure. Further, when pressure changes simultaneously occur in both of the adjacent pressure generating chambers 12, the second partition wall does not deform, so that there are no decreases in discharge property of ink droplets, particularly weight and discharge rate of ink. Accordingly, when the second partition wall is thin and low in rigidity, there occurs so-called structural crosstalk in which depending on the presence or absence of pressure changes in the adjacent pressure generating chambers 12, there occur variations in discharge property of ink droplets. This causes landing misregistration of ink droplets, causing a decrease in print quality. Such structural crosstalk due to low rigidity of the second partition walls of the drain-side individual flow passages 18 has a great effect especially when the thickness $d_1$, of each of the second partition walls that separate the drain-side individual flow passages 18 from one another is smaller than the thickness $d_2$ of each of the partition walls 11 of the pressure generating chambers 12. That is, when drain-side individual flow passages at the same distance from the nozzle surface 20*a* are provided as illustrated in FIG. 6, the thickness $d_1$ of each of the second partition walls that separate the drain-side individual flow passages from one another tends to be smaller than the thickness $d_2$ of each of the partition walls 11 that separate the pressure generating chambers 12 from one another. Moreover, although structural crosstalk also occurs at the partition walls 11 that separate the pressure generating chamber 12 from one another, structural crosstalk occurs at both the partition walls 11 of the pressure generating chambers 12 and the second partition walls of the drain-side individual flow passages 18 when the thickness $d_1$ of each of the second partition walls of the drain-side individual flow passages 18 is smaller and lower in rigidity than the thickness $d_2$ of each of the partition walls 11 of the pressure generating chambers 12, and have a greater effect on ink discharge properties, particularly weights and discharge rates. Further, also when the drain-side individual flow passages 18 are long in path, the second partition walls that separate the drain-side individual flow passages 18 from one another are low in rigidity. Further, when the second partition walls are small in thickness, the drain-side individual flow passages 18 cannot be made large in flow passage cross-sectional area, with the result that the drain-side individual flow passages 18 become higher in flow passage resistance.

The present embodiment, in which the first drain-side individual flow passages 181 and the second drain-side individual flow passages 182 are alternately arranged one by one in the first direction X, makes it possible to reduce the occurrence of structural crosstalk by making the second partition walls that separate the drain-side individual flow passages 18 from one another in the first direction X thicker to suppress decreases in rigidity of the second partition walls. This makes it possible to reduce landing misregistration and improve print quality by reducing the occurrence of variations in discharge property, i.e. weight and discharge rate, of ink droplets by inhibiting the second partition walls from flexurally deforming due to pressure changes in ink in the pressure generating chambers 12. Further, since the second partition walls can be made thicker, the drain-side individual flow passages 18 do not interfere with one another and the drain-side individual flow passages 18 can be made comparatively large in flow passage cross-sectional area even when the pressure generating chambers 12 are densely arranged in the first direction X. This makes it possible to densely arrange the nozzles 21 and to reduce the flow passage resistance of the drain-side individual flow passages 18.

Further, by making the thickness $d_1$ of each of the second partition walls that separate the drain-side individual flow passages 18 from one another greater than the thickness $d_2$ of each of the partition walls 11 serving as the first partition walls that separate the pressure generating chambers 12 from one another, the pressure generating chambers 12 can be densely arranged, so that the nozzles 21 can be densely arranged to achieve higher resolution. Further, by increasing the excluded volumes of the pressure generating chambers 12, the discharge properties of ink droplets can be improved.

Further, by providing the first drain-side individual flow passages 181 and the second drain-side individual flow passages 182 as the drain-side individual flow passages 18 and increasing the thickness $d_1$ of each of the second partition walls that separate the drain-side individual flow passages 18 from one another, the nozzle plate 20 and the communicating plate 15 can be bonded to each other by a larger area with improved joint strength. Further, since the area of bonding to the nozzle plate 20 can be increased by increasing the thickness $d_1$ of each of the second partition walls that separate the drain-side individual flow passages 18 from one another, the occurrence of malfunctions such as defects in discharge of ink droplets caused by a loss of pressure due to leakage of ink and discharge of ink droplets from adjacent flow passages can be reduced by reducing leakage of ink between adjacent drain-side individual flow passages 18.

The present embodiment has illustrated a configuration in which the nozzle plate 20 is provided on a side of the communicating plate 15 opposite to the flow passage forming substrate 10. However, for example, even when a different member is joined to the communicating plate 15, detachment of the different member from the communicating plate 15 can be similarly inhibited by increasing the area of bonding to the different member and malfunctions such as defects in discharge of ink droplets due to leakage of ink can be similarly reduced by increasing the area of bonding between the second partition walls and the different member.

Further, by providing the first drain-side individual flow passages 181 and the second drain-side individual flow passages 182 as the drain-side individual flow passages 18, bonding strength can be improved by increasing the area of bonding between the first communicating plate 151 and the second communicating plate 152 and defects in discharge of ink can be reduced by reducing leakage of ink between adjacent drain-side individual flow passages 18. Incidentally, for example, providing only the second drain-side individual flow passages 182 as the drain-side individual flow passages 18 decreases the area of bonding between the first communicating plate 151 and the second communicating plate 152.

In such a recording head 1, ink supplied into the supply-side common flow passages 41 through the ink inlets 49 is supplied to the drain-side common flow passage 17 through the ink supply passages 13, the pressure generating chambers 12, the nozzle communicating passages 16, and the drain-side individual flow passages 18, which serve as individual flow passages. The ink supplied to the drain-side common flow passage 17 is drained out of the recording head 1 through the drain passages 42. The ink drained out of the recording head 1 through the drain passages 42 may be returned to the ink supply unit, which supplies ink to the recording head 1, to circulate between the ink supply unit and the recording head 1 or may be drained into a part other than the ink supply unit, for example, to be disposed of. By thus circulating or disposing of the ink supplied to the pressure generating chambers 12, bubbles in the ink can be drained out of the recording head 1 without staying in the supply-side common flow passages 41 or individual flow passages such as the pressure generating chambers 12. This makes it possible to reduce defects in discharge of ink droplets due to bubbles. Further, draining ink out of individual flow passages makes it possible to reduce thickening of the ink by the nozzles 21 and to reduce sedimentation of a component contained in the ink, bringing about improvement in print quality by reducing the occurrence of variations in discharge property of ink droplets, i.e. weight and discharge rate of ink droplets.

As described above, a recording head 1, which is a liquid ejecting head according to the present embodiment, includes a flow passage forming substrate 10, a protective substrate 30, a case member 40, a communicating plate 15, a nozzle plate 20, and a compliance substrate 45 serving as a flow passage member that includes a plurality of individual flow passages including nozzles 21 that eject ink serving as liquid and pressure generating chambers 12 that communicate with the nozzles 21, a supply-side common flow passage 41 through which to supply the ink to the plurality of individual flow passages, and a drain-side common flow passage 17 through which to drain the ink from the plurality of individual flow passages and piezoelectric actuators 300 serving as energy generating elements that effect pressure changes in the ink in the pressure generating chambers 12 to cause the ink to be discharged from the nozzles 21. The individual flow passages include ink supply passages 13, the pressure generating chambers 12, nozzle communicating passages 16, and the nozzles 21 as a plurality of supply-side individual flow passages between the supply-side common flow passage 41 and the nozzles 21 and a plurality of drain-side individual flow passages 18 between the nozzles 21 and the drain-side common flow passage 17. Second partition walls that separate the plurality of drain-side individual flow passages 18 from one another are thicker than first partition walls that separate the plurality of supply-side individual flow passages from one another.

By thus making the thickness $d_1$ of each of the second partition walls that separate the plurality of drain-side individual flow passages 18 from one another greater than the thickness $d_2$ of each of the first partition walls that separate the supply-side individual flow passages from one another or, in the present embodiment, each of partition walls 11 of the pressure generating chambers 12, the second partition wall is inhibited from deforming when a pressure change is effected only in one of the adjacent pressure generating chambers 12, so that the second partition wall can be inhibited from absorbing the pressure. Accordingly, by equalizing pressure changes in the pressure generating chambers 12 between the case of pressure changes simultaneously effected in both of the adjacent pressure generating chambers 12 and the case of a pressure change effected only in one of the pressure generating chambers 12, the occurrence of variations in discharge property, i.e. weight and discharge rate, of ink droplets can be reduced.

Further, by making the first partition walls smaller in thickness than the second partition walls, the supply-side individual flow passages can be densely arranged, so that the nozzles 21 can be densely arranged to achieve higher resolution.

Furthermore, by making the second partition walls greater in thickness than the first partition walls, the area of bonding between members forming the drain-side individual flow passages 18 can be increased. This makes it possible to improve bonding strength and to inhibit detachment of one member from another. Further, by increasing the thickness of each of the second partition walls between the drain-side individual flow passages 18, leakage of ink between drain-side individual flow passages 18 adjacent to each other can be reduced, so that defects in discharge can be reduced.

It should be noted that the clause "the second partition walls are thicker than the first partition walls" means that the second partition walls are thicker than the thinnest ones of the first partition walls. Accordingly, the first partition walls may include first partition walls that are thicker than the second partition walls, provided some of the first partition walls are thinner than the second partition walls.

Further, the recording head 1 according to the present embodiment may be configured such that the second partition walls are thicker than the partition walls 11 that separate the plurality of pressure generating chambers 12 from one another. This configuration makes it possible to densely arrange the plurality of pressure generating chambers 12 and to improve the discharge properties of ink droplets by increasing the excluded volumes of the pressure generating chambers 12.

Further, the recording head 1 according to the present embodiment may be configured such that the flow passage member includes the plurality of nozzle communicating passages 16 as communicating passages between the nozzles 21 and the pressure generating chambers 12 and that the second partition walls are thicker than partition walls that separate the plurality of nozzle communicating passages 16 from one another. With this configuration, even when the nozzle communicating passages 16 are densely arranged and the nozzles 21 are made higher in resolution, the second partition walls that separate the drain-side individual flow passages 18 from one another are inhibited from becoming thinner, so that the occurrence of structural crosstalk due to decreases in rigidity of the second partition walls can be reduced.

Further, the recording head 1 according to the present embodiment may be configured such that the plurality of nozzles 21 are arranged on a nozzle surface 20*a* and that the plurality of drain-side individual flow passages 18 include first drain-side individual flow passages 181 and second drain-side individual flow passages 182 as flow passages that are different in distance from the nozzle surface 20*a* in a third direction Z orthogonal to the nozzle surface 20*a*. With this configuration, by using the first drain-side individual flow passages 181 and the second drain-side individual flow passages 182, which are different in distance from the nozzle surface 20*a*, as the drain-side individual flow passages 18, the second partition walls that separate the drain-side individual flow passages 18 from one another can be easily made greater in thickness and the drain-side individual flow passages 18 can be made larger in flow passage cross-sectional area, so that increases in flow passage resistance can be suppressed. Further, the first drain-side individual flow passages 181 and the second drain-side individual flow passages 182 can be easily made uniform in flow passage length, so that variations in flow passage resistance can be reduced.

Further, a recording head 1 according to the present embodiment includes a flow passage forming substrate 10, a protective substrate 30, a case member 40, a communicating plate 15, a nozzle plate 20, and a compliance substrate 45 serving as a flow passage member that includes a plurality of individual flow passages including nozzles 21 that discharge ink serving as liquid and pressure generating chambers 12, a supply-side common flow passage 41 through which to supply the ink to the plurality of individual flow passages, and a drain-side common flow passage 17 through which to drain the ink from the plurality of individual flow passages and piezoelectric actuators 300 serving as energy generating elements that effect pressure changes in the ink in the pressure generating chambers 12 to cause the ink to be discharged from the nozzles 21. The individual flow passages include ink supply passages 13, the pressure generating chambers 12, nozzle communicating passages 16, and the nozzles 21 as a plurality of supply-side individual flow passages between the supply-side common flow passage 41 and the nozzles 21 and a plurality of drain-side individual flow passages 18 between the nozzles 21 and the drain-side common flow passage 17. The plurality of nozzles 21 are arranged on a nozzle surface 20*a*. The plurality of drain-side individual flow passages 18 include first drain-side individual flow passages 181 and second drain-side individual flow passages 182 as flow passages that are different in distance from the nozzle surface 20*a* in a third direction Z orthogonal to the nozzle surface 20*a*.

By thus using the first drain-side individual flow passages 181 and the second drain-side individual flow passages 182, which are different in distance from the nozzle surface 20*a*, as the drain-side individual flow passages 18, the second partition walls that separate the drain-side individual flow passages 18 from one another can be easily made greater in thickness and the drain-side individual flow passages 18 can be made larger in flow passage cross-sectional area, so that increases in flow passage resistance can be suppressed.

Further, by making the second partition walls greater in thickness, the area of bonding between members forming the drain-side individual flow passages 18 can be increased. This makes it possible to improve bonding strength and to inhibit detachment of one member from another. Further, by increasing the thickness of each of the second partition walls that the drain-side individual flow passages 18 from one another, leakage of ink between drain-side individual flow passages 18 adjacent to each other can be reduced, so that defects in discharge can be reduced.

It should be noted that the second partition walls that separate the drain-side individual flow passages 18 from one another include partition walls that are thinner than the first partition walls that separate the plurality of supply-side individual flow passages from one another.

Further, the recording head 1 according to the present embodiment may be configured such that of the plurality of drain-side individual flow passages 18, the first drain-side individual flow passages 181 and the second drain-side individual flow passages 182, which are flow passages that are different in distance from the nozzle surface 20*a*, communicate with the same drain-side common flow passage 17. When the first drain-side individual flow passages 181 and the second drain-side individual flow passages 182 communicate with different drain-side common flow passages, respectively, a space in which to provide two drain-side common flow passages is needed, resulting in an increase in size. On the other hand, the foregoing configuration, in which the first drain-side individual flow passages 181 and the second drain-side individual flow passages 182 communicate with the same drain-side common flow passage 17, make it only necessary to secure a space in which to provide one drain-side common flow passage 17, thus making it possible to achieve a reduction in size. Of course, of the plurality of drain-side individual flow passages 18, flow passages that are different in distance from the nozzle surface 20*a* may communicate with different drain-side common flow passages, respectively.

Further, the recording head 1 according to the present embodiment may be configured such that of the plurality of drain-side individual flow passages 18, the first drain-side individual flow passages 181, which are flow passages whose distance from the nozzle surface 20*a* is a first distance, and the second drain-side individual flow passages 182, which are flow passages whose distance from the nozzle surface 20*a* is a second distance that is longer than the first distance, are repeatedly arranged in a first direction X in which the plurality of drain-side individual flow passages 18 are placed side by side. This configuration, in which the first drain-side individual flow passages 181 and the second drain-side individual flow passages 182 are repeatedly arranged in the first direction X, makes it possible to make each of the second partition walls that separate the drain-side individual flow passages 18 from one another comparatively great in thickness and to give the second partition walls a regularity of thickness, thus making it possible to reduce variations in strength of the second partition walls.

Incidentally, the repeated arrangement of the first drain-side individual flow passages 181 and the second drain-side individual flow passages 182 in the first direction X encompasses an alternate arrangement of one of these first drain-side individual flow passages 181 and one of these second drain-side individual flow passages 182 and an alternate arrangement of two or more of these first drain-side individual flow passages 181 and two or more of these second drain-side individual flow passages 182. In either case, a regularly repeated arrangement makes it possible to increase the thickness of each of the second partition walls that separate the drain-side individual flow passages 18 from one another and give the plurality of second partition walls a regularity of thickness, thus making it possible to reduce variations in strength of the second partition walls. In particular, an alternate arrangement of one of these first drain-side individual flow passages 181 and one of these second drain-side individual flow passages 182 makes it easy to make the plurality of second partition walls that separate the drain-side individual flow passages 18 from one another uniform in thickness, thus making it possible to further reduce variations in strength of the second partition walls.

Figure 7:
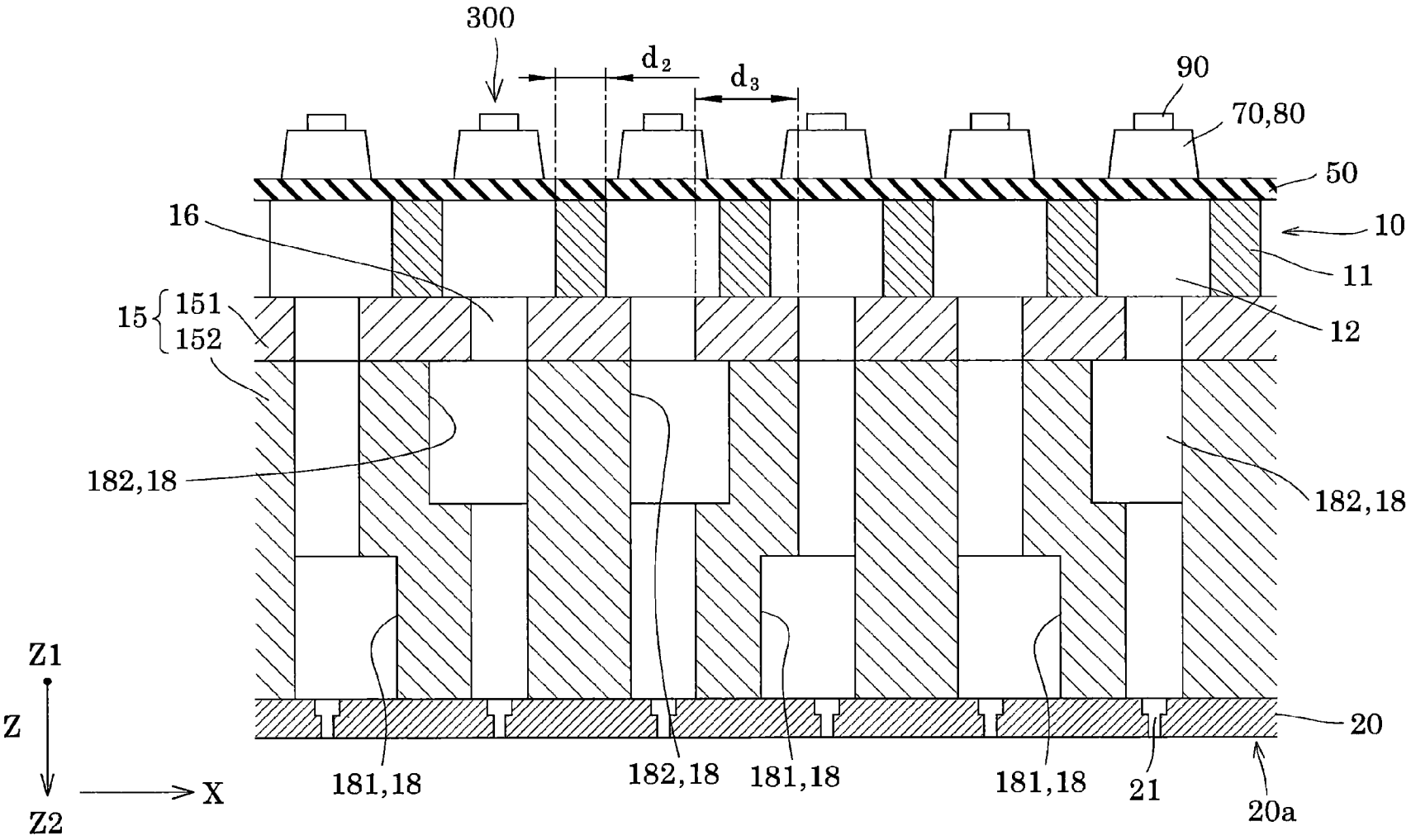
FIG. 7 is a cross-sectional view illustrating a modification of the recording head according to Embodiment 1.
Figure 8:
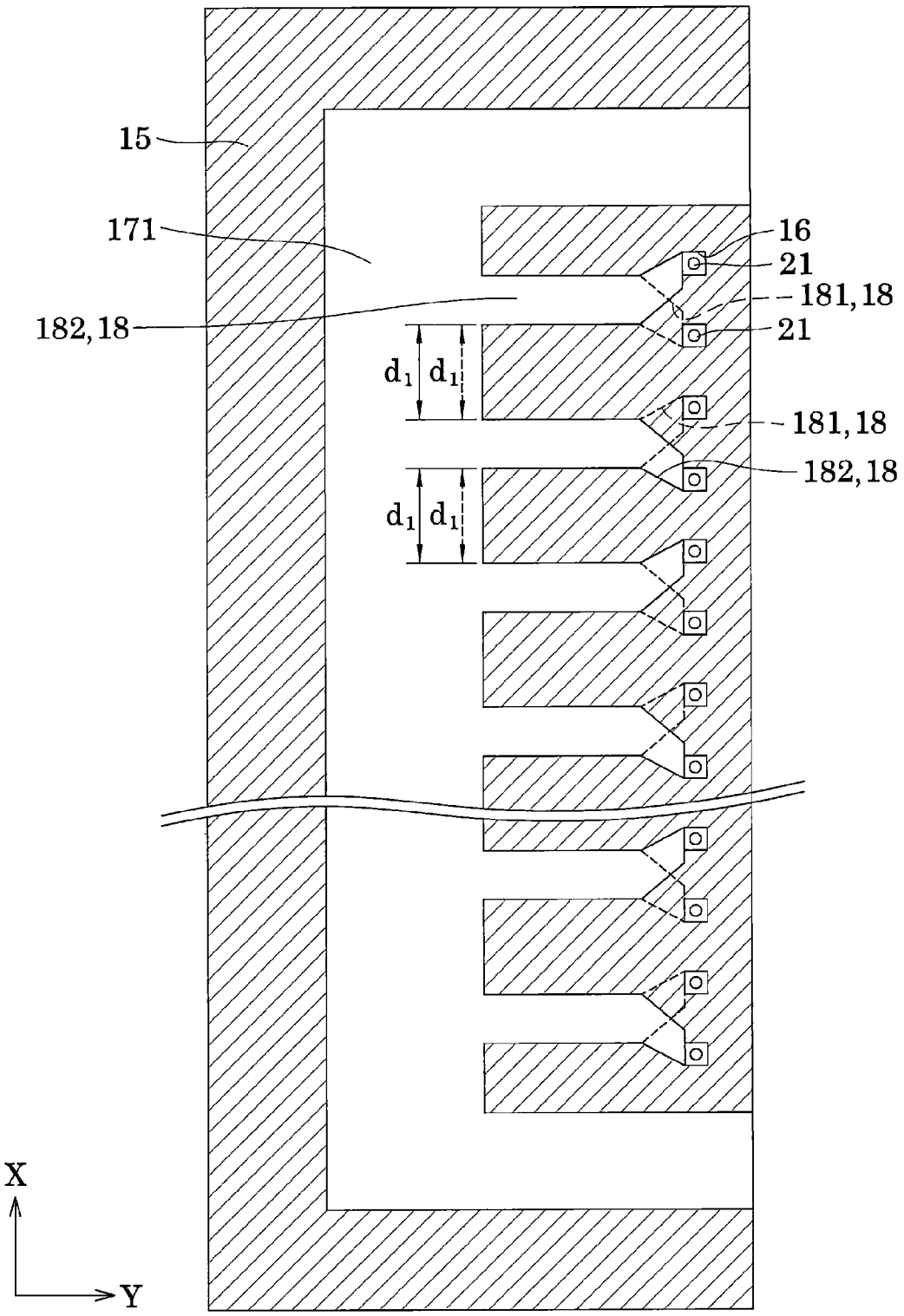
FIG. 8 is a cross-sectional view illustrating the modification of the recording head according to Embodiment 1.

Note here that, for example, even when two of these first drain-side individual flow passages 181 and two of these second drain-side individual flow passages 182 are alternately arranged in the first direction X as illustrated in FIG. 7, a second partition wall that separates two first drain-side individual flow passages 181 from each other and a second partition wall that separates two second drain-side individual flow passages 182 from each other can be provided to have the same thickness $d_1$ as illustrated in FIG. 8.

That is, two first drain-side individual flow passages 181 contiguous to each other in the first direction X are provided so that a distance in the first direction X is greater beside the drain-side common flow passage 17 than beside the nozzle communicating passages 16. Similarly, two second drain-side individual flow passages 182 contiguous to each other in the first direction X are provided so that a distance in the first direction X is greater beside the drain-side common flow passage 17 than beside the nozzle communicating passages 16. This makes it possible to make the thickness of the second partition wall that separates the first drain-side individual flow passages 181 from each other and the thickness of the second partition wall that separates the second drain-side individual flow passages 182 from each other equal to the same thickness $d_1$, thus making it possible to reduce variations in strength of the second partition walls.

Further, the recording head 1 according to the present embodiment may be configured such that each of the drain-side individual flow passages 18 is smaller in width than in height as seen from a direction of flow of the drain-side individual flow passage 18. This configuration makes it possible to make each of the second partition walls that separate the drain-side individual flow passages 18 from one another comparatively great in thickness and to suppress increases in flow passage resistance by making the drain-side individual flow passages 18 comparatively large in flow passage cross-sectional area. Of course, the drain-side individual flow passages 18 may be greater in width than in height.

In the present embodiment, the communicating plate 15 is formed by stacking a first communicating plate 151 and a second communicating plate 152, whereby drain-side individual flow passages 18 that are different in distance from the nozzle surface 20*a* can be easily formed. Of course, the communicating plate 15 is not limited to one in which a first communicating plate 151 and a second communicating plate 152 are stacked in the third direction Z or one in which a first communicating plate 151, a second communicating plate 152, and a third communicating plate 153 are stacked in the third direction Z. For example, the communicating plate 15 may be constituted by a plurality of members divided in directions including the first direction X and a second direction Y, or the communicating plate 15 may be one formed by a single member. Incidentally, the single-member communicating plate 15 may be formed, for example, by injection molding or the like.

Further, although, in the present embodiment, the thickness $d_1$ of the second partition wall that separates the first drain-side individual flow passages 181 from each other and the thickness $d_1$ of the second partition wall that separates the second drain-side individual flow passages 182 from each other are equal to each other, this is not intended to impose any particular limitation. The thickness of the second partition wall that separates the first drain-side individual flow passages 181 from each other and the thickness of the second partition wall that separates the second drain-side individual flow passages 182 from each other may be different from each other. That is, the first drain-side individual flow passages 181 and the second drain-side individual flow passages 182 may be different in flow passage cross-sectional shape from each other. Of course, by making the first drain-side individual flow passages 181 and the second drain-side individual flow passages 182 equal in path length by making them equal in flow passage cross-sectional shape, i.e. making them equal in flow passage cross-sectional area, as mentioned above, uniform flow passage resistance can be attained, and variations in discharge property of ink droplets that are discharged from those ones of the nozzles 21 with which the first drain-side individual flow passages 181 communicate and those ones of the nozzles 21 with which the second drain-side individual flow passages 182 communicate can be reduced.

Further, in the present embodiment, by providing the first drain-side individual flow passages 181 and the second drain-side individual flow passages 182 as the drain-side individual flow passages 18, the thickness $d_1$ of each of the second partition walls that separate the drain-side individual flow passages 18 from one another is made greater than the thickness of each of the first partition walls that separate the supply-side individual flow passages from one another. However, this is not intended to impose any particular limitation. When first drain-side individual flow passages 181 and second drain-side individual flow passages 182 that are different in distance from the nozzle surface 20*a* are provided, the thickness $d_1$ of each of the second partition walls may be equal to or smaller than the thickness of each of the first partition walls. That is, in the present embodiment, since the thinnest ones of the first partition walls are the partition walls 11 of the pressure generating chambers 12, the thickness $d_1$ of each of the second partition walls may be equal to or smaller than the thickness $d_2$ of each of the partition walls 11, i.e. $d_1$ $d_2$. By thus providing the first drain-side individual flow passages 181 and the second drain-side individual flow passages 182 as the drain-side individual flow passages 18, a large space in which the drain-side individual flow passages 18 can be provided is secured, and by providing the drain-side individual flow passages 18 with comparatively large flow passage cross-sectional areas in this space, drainage properties can be improved with reduced flow passage resistance of the drain-side individual flow passages 18.

Figure 9:
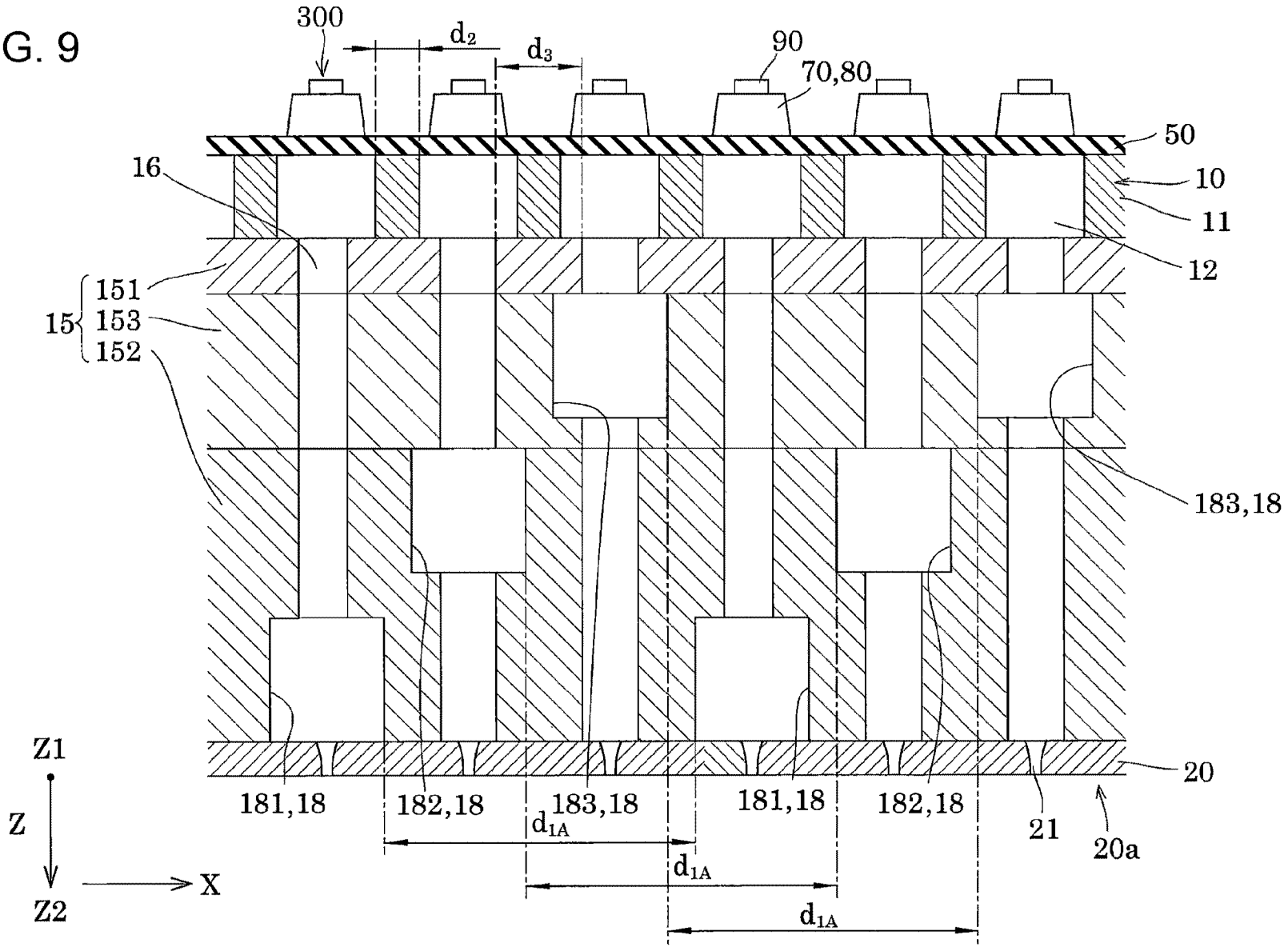
FIG. 9 is a cross-sectional view illustrating the modification of the recording head according to Embodiment 1.

Furthermore, although, in the present embodiment, the communicating plate 15 is constituted by stacking the first communicating plate 151 and the second communicating plate 152 and the first drain-side individual flow passages 181 and the second drain-side individual flow passages 182, which are different in distance from the nozzle surface 20*a* in the third direction Z, are provided as the drain-side individual flow passages 18, this is not intended to impose any particular limitation. There may be provided three or more types of drain-side individual flow passage that are different in distance from the nozzle surface 20*a* in the third direction Z. Such an example is illustrated in FIG. 9. FIG. 9 is a cross-sectional view illustrating a modification of a recording head according to Embodiment 1 of the present disclosure.

As illustrated in FIG. 9, the communicating plate 15 includes a first communicating plate 151 provided toward the Z1 side, i.e. beside the flow passage forming substrate 10, a second communicating plate 152 provided toward the Z2 side, i.e. beside the nozzle plate 20, and a third communicating plate 153 provided between the first communicating plate 151 and the second communicating plate 152.

Such a communicating plate 15 is provided with drain-side individual flow passages 18 including first drain-side individual flow passages 181, second drain-side individual flow passages 182, and third drain-side individual flow passages 183 that are different in distance from the nozzle surface 20*a* in the third direction Z.

The first drain-side individual flow passages 181 are located closest to the nozzle surface 20*a* in the third direction Z and provided between the second communicating plate 152 and the nozzle plate 20. Specifically, the first drain-side individual flow passages 181 are formed by covering, with the nozzle plate 20, recesses so formed in the second communicating plate 152 as to be open toward the nozzle plate 20.

The second drain-side individual flow passages 182 are located second closest to the nozzle surface 20*a* in the third direction Z and provided between the second communicating plate 152 and the third communicating plate 153. Specifically, the second drain-side individual flow passages 182 are formed by covering, with the third communicating plate 153, recesses so provided in the second communicating plate 152 as to be open toward the third communicating plate 153. Alternatively, the second drain-side individual flow passages 182 may be formed by forming recesses in the third communicating plate 153 and covering them with the second communicating plate 152 or may be formed by forming recesses in both the second communicating plate 152 and the third communicating plate 153.

The third drain-side individual flow passages 183 are located farthest from the nozzle surface 20*a* in the third direction Z and provided between the first communicating plate 151 and the third communicating plate 153. Specifically, the third drain-side individual flow passages 183 are formed by covering, with the second communicating plate 152, recesses so provided in the third communicating plate 153 as to be open toward the second communicating plate 152. Alternatively, the third drain-side individual flow passages 183 may be formed by forming recesses in the first communicating plate 151 and covering them with the third communicating plate 153 or may be formed by forming recesses in both the first communicating plate 151 and the third communicating plate 153.

Such three types of drain-side individual flow passage that are different in distance from the nozzle surface 20*a*, namely the first drain-side individual flow passages 181, the second drain-side individual flow passages 182, and the third drain-side individual flow passages 183, are repeatedly arranged in the first direction X in which the drain-side individual flow passages 18 are placed side by side. Specifically, each one of the first drain-side individual flow passages 181, each one of the second drain-side individual flow passages 182, and each one of the third drain-side individual flow passages 183 constitute a group in which the first drain-side individual flow passage 181, the second drain-side individual flow passage 182, and the third drain-side individual flow passage 183 are placed side by side in this order from one side to another in the first direction X, and this group is repeated in the first direction X. For this reason, the thickness $d_{1A}$ of each of second partition walls that separate the drain-side individual flow passages 18 placed side by side in the first direction X from one another can be made greater than the thickness $d_1$ of each of the second partition walls, illustrated above in FIG. 5, that separate the drain-side individual flow passages 18 from one another. Incidentally, since the first drain-side individual flow passages 181, the second drain-side individual flow passages 182, and the third drain-side individual flow passages 183 are equal in flow passage cross-sectional shape and flow passage cross-sectional area to one another and equal in path length to one another, there are no variations in thickness of the second partition walls that separate the first drain-side individual flow passages 181 placed side by side in the first direction X from one another, second partition walls that separate the second drain-side individual flow passages 182 from one another, and second partition walls that separate the third drain-side individual flow passages 183 from one another, so that the second partition walls can be made uniform in strength and variations in discharge property of ink droplets can be reduced with uniform flow passage resistance. Of course, the second partition walls that separate the first drain-side individual flow passages 181 from one another, the second partition walls that separate the second drain-side individual flow passages 182 from one another, and the second partition walls that separate the third drain-side individual flow passages 183 from one another may be different in thickness from one another. Further, the number of types of drain-side individual flow passage 18 that are different in distance from the nozzle surface 20*a* is not limited to three as illustrated in FIG. 9 but may be four or more.

Even when there are provided three types of drain-side individual flow passage 18 that are different in distance from the nozzle surface 20*a*, it can be said that of the plurality of drain-side individual flow passages 18, flow passages whose distance from the nozzle surface 20*a* is a first distance and flow passages whose distance from the nozzle surface 20*a* is a second distance that is longer than the first distance are repeatedly arranged in the first direction X in which the plurality of drain-side individual flow passages 18 are placed side by side. That is, assuming that the first-distance flow passages are the first drain-side individual flow passages 181 and the second-distance flow passages are the second drain-side individual flow passages 182 in FIG. 9, it can be said that the first drain-side individual flow passages 181 and the second drain-side individual flow passages 182 are repeatedly arranged in the first direction X. Further, assuming that the first-distance flow passages are the second drain-side individual flow passages 182 and the second-distance flow passages are the third drain-side individual flow passages 183 in FIG. 9, it can be said that the second drain-side individual flow passages 182 and the third drain-side individual flow passages 183 are repeatedly arranged in the first direction X. Similarly, assuming that the first-distance flow passages are the first drain-side individual flow passages 181 and the second-distance flow passages are the third drain-side individual flow passages 183 in FIG. 9, it can be said that the first drain-side individual flow passages 181 and the third drain-side individual flow passages 183 are repeatedly arranged in the first direction X.

Embodiment 2

Figure 10:
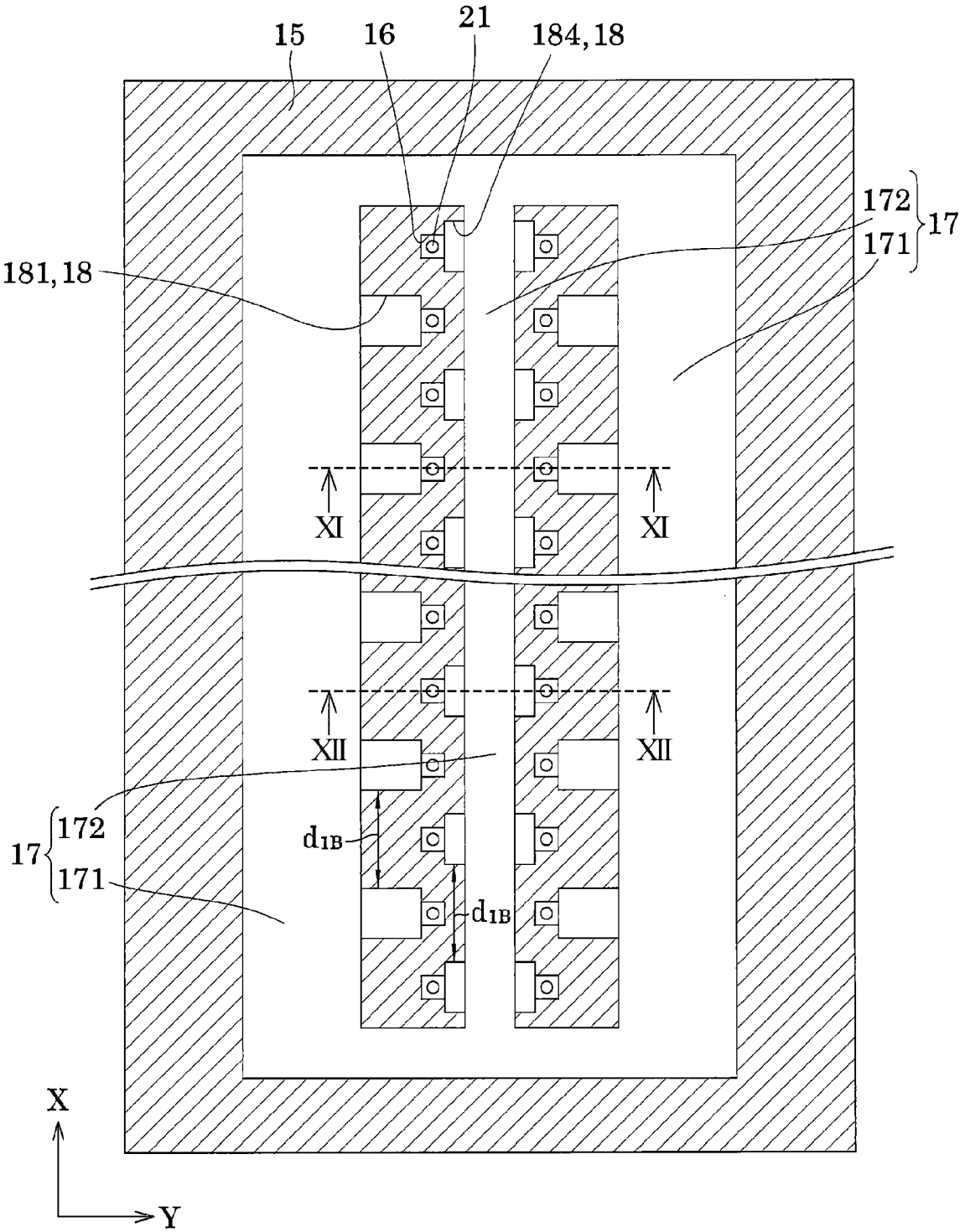
FIG. 10 is a cross-sectional view of a recording head according to Embodiment 2.
Figure 11:
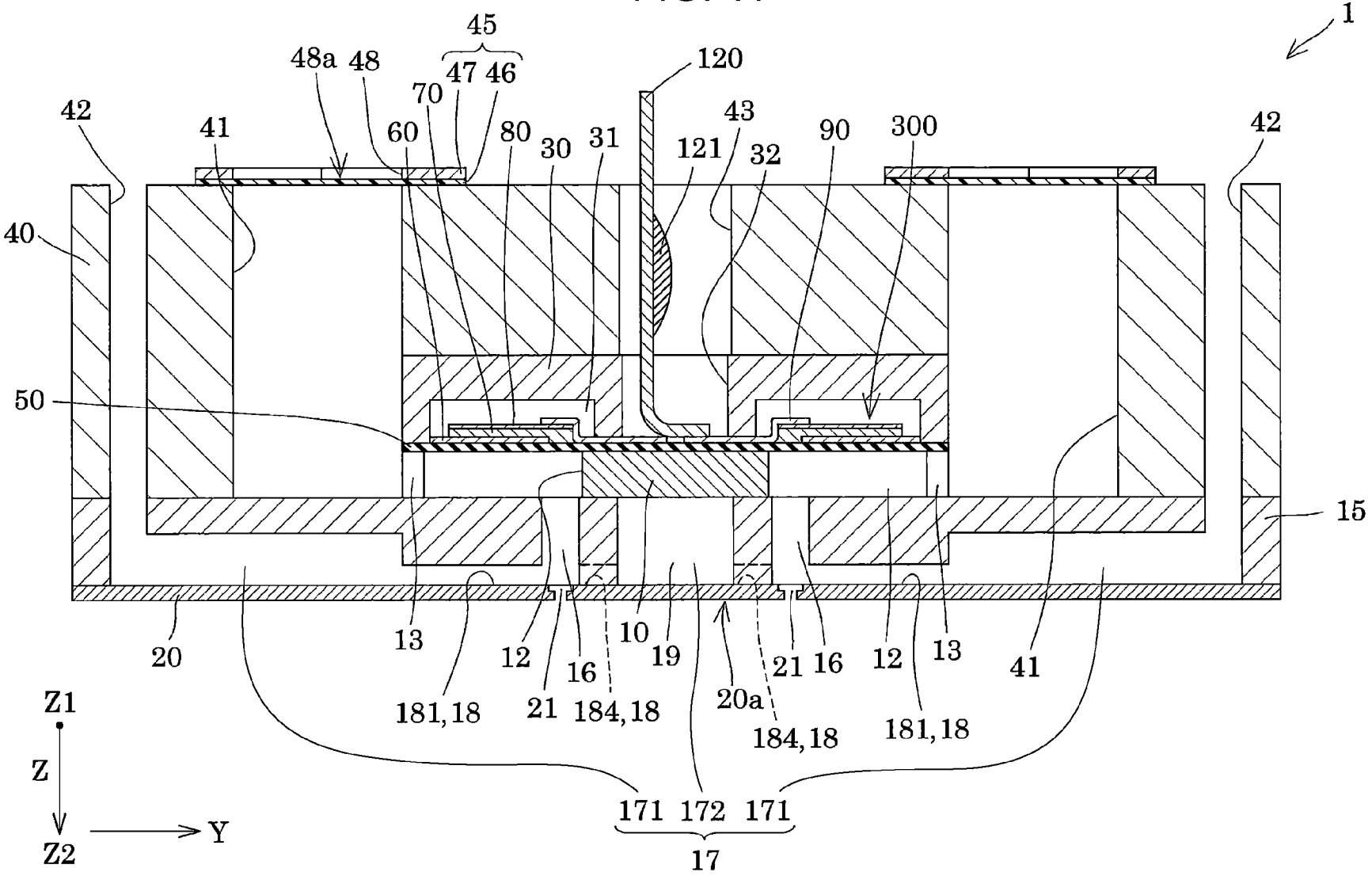
FIG. 11 is a cross-sectional view of the recording head according to Embodiment 2.
Figure 12:
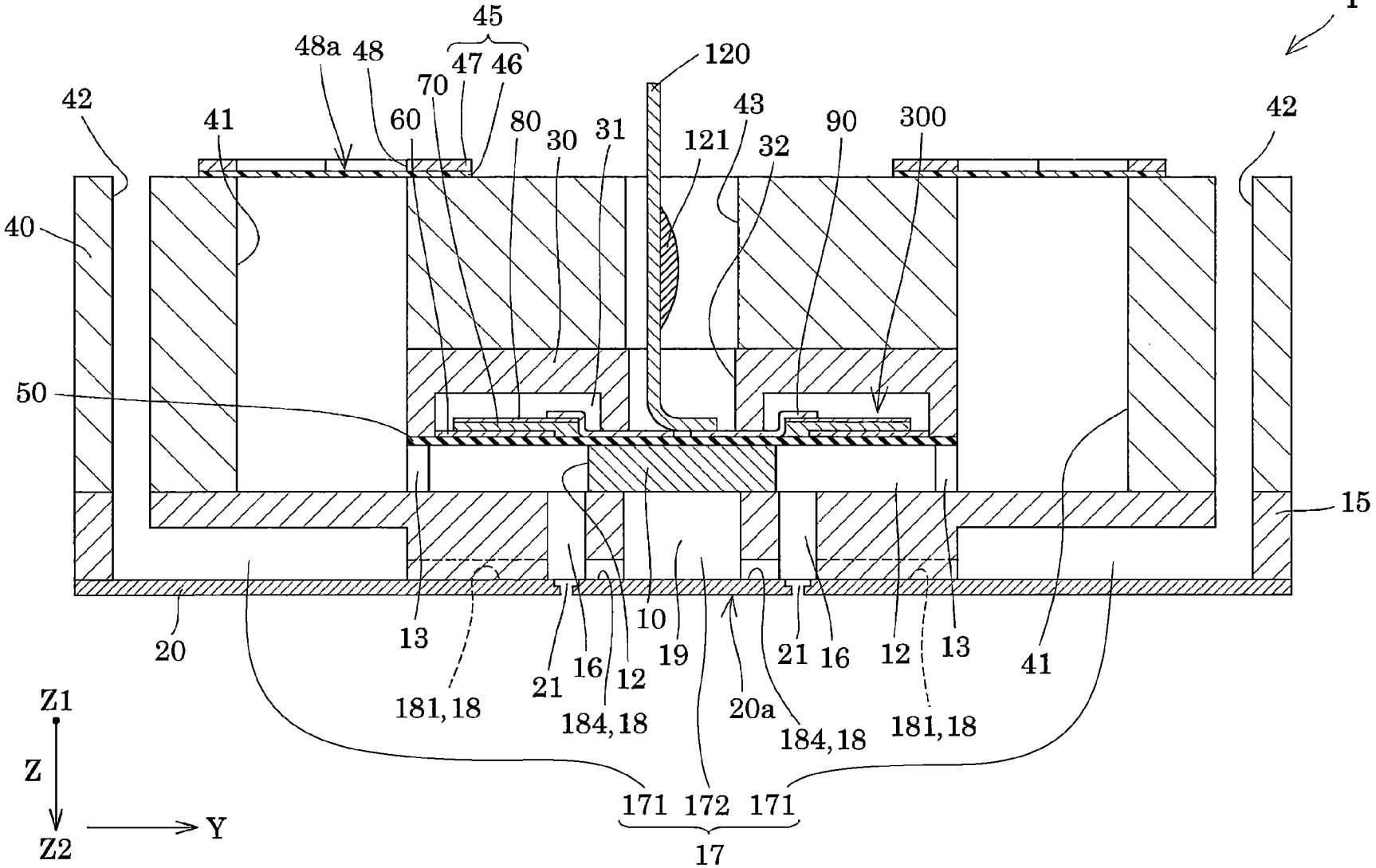
FIG. 12 is a cross-sectional view of the recording head according to Embodiment 2.

FIG. 10 is a cross-sectional view of a communicating plate of a recording head according to Embodiment 2 of the present disclosure as taken along a planar direction of a nozzle surface. FIG. 11 is a cross-sectional view taken along line XI-XI in FIG. 10. FIG. 12 is a cross-sectional view taken along line XII-XII in FIG. 10. It should be noted that members which are similar to those of the embodiment described above are given the same reference signs and are not repeatedly described below.

In the present embodiment, as illustrated, the communicating plate 15 is constituted by one substrate. Of course, the communicating plate 15 may be one obtained by stacking two or more substrates in the third direction Z or may be one obtained by stacking two or more substrates in a direction that crosses the third direction Z.

The communicating plate 15 is provided with nozzle communicating passages 16 through which the pressure generating chambers 12 and the nozzles 21 communicate with each other.

Further, the communicating plate 15 has, as the drain-side common flow passage 17, first drain-side common flow passages 171 and a second drain-side common flow passage 172 between which the plurality of nozzles 21 are interposed in an in-plane direction of the nozzle surface 20*a*, i.e. between which the rows of nozzles are interposed in the second direction Y. As with the drain-side common flow passage 17 described above, the first drain-side common flow passages 171 are disposed in such positions as to at least partially overlap the supply-side common flow passages 41 when seen in plan view from the third direction Z.

Further, the first drain-side common flow passages 171 are bored through the second communicating plate 152 in the third direction Z, and ends of the first drain-side common flow passages 171 opposite to the nozzle communicating passages 16 in the second direction Y are extended further outward than the supply-side common flow passages 41. Connected to these ends of the first drain-side common flow passages 171 extended further outward than the supply-side common flow passages 41 are drain passages 42 provided across the first communicating plate 151 and the case member 40.

Further, the second drain-side common flow passage 172 is provided between the nozzle communicating passages 16 in the second direction Y. The second drain-side common flow passage 172 is bored through the communicating plate 15 in the third direction Z, has its Z1-side opening sealed with the flow passage forming substrate 10, and has its Z2-side opening sealed with the nozzle plate 20.

A total of two such second drain-side common flow passages 172 may be provided one by one for each one of the first drain-side common flow passages 171, or one such second drain-side common flow passage 172 may be provided in common for the two first drain-side common flow passages 171. In the present embodiment, one common second drain-side common flow passage 172 is provided for the two first drain-side common flow passages 171.

Even when one second drain-side common flow passage 172 is provided in common for the two first drain-side common flow passages 171, the first drain-side common flow passages 171 and the second drain-side common flow passage 172 are provided in such positions that the plurality of nozzles 21 or, in the present embodiment, the rows of nozzles are interposed therebetween in the in-plane directions of the nozzle surface 20*a*.

Further, in the present embodiment, the two first drain-side common flow passages 171 and the one second drain-side common flow passage 172 are successively provided so as to be connected at both ends thereof in the first direction X. For this reason, the two first drain-side common flow passages 171 and the one second drain-side common flow passage 172 are supplied with the same ink.

Incidentally, when one second drain-side common flow passage 172 is provided between two rows of nozzles 21 in the in-plane directions of the nozzle surface 20*a* as in the case of the present embodiment, the same ink is discharged from the two rows of nozzles 21, as the second drain-side common flow passage 172 communicates with the two rows of nozzles 21. Further, although not illustrated, when two second drain-side common flow passages 172 are provided between two rows of nozzles 21 in the in-plane directions of the nozzle surface 20*a*, it is possible both to discharge different types of ink from each separate row of nozzles 21 and to discharge the same ink from the two rows of nozzles 21.

Further, the communicating plate 15 is provided with drain-side individual flow passages 18. In the present embodiment, the drain-side individual flow passages 18 include first drain-side individual flow passages 181 and fourth drain-side individual flow passages 184 that are different in orientation from the nozzles 21 in the first direction X and the second direction Y, which are the in-plane directions of the nozzle surface 20*a* on which the nozzles 21 are arranged.

The first drain-side individual flow passages 181 are extended from a first side of the second direction Y along the second direction Y, i.e. from the nozzles 21 toward the first drain-side common flow passages 171. Such a first drain-side individual flow passage 181 is formed by providing a recess between the communicating plate 15 and the nozzle plate 20, i.e. in the communicating plate 15, so that the recess is open toward the nozzle plate 20 and covering the recess with the nozzle plate 20.

The fourth drain-side individual flow passages 184 are extended from a second side of the second direction Y along the second direction Y, i.e. from the nozzles 21 toward the second drain-side common flow passage 172. Such a fourth drain-side individual flow passage 184 is formed by providing a recess between the communicating plate 15 and the nozzle plate 20, i.e. in the communicating plate 15, so that the recess is open toward the nozzle plate 20 and covering the recess with the nozzle plate 20. That is, the first drain-side individual flow passages 181 and the fourth drain-side individual flow passages 184, which are the drain-side individual flow passages 18 of the present embodiment, are provided at the same distance from the nozzle surface 20*a* in the third direction Z. Further, the first drain-side individual flow passages 181 and the fourth drain-side individual flow passages 184 are provided so as to be equal in flow passage cross-sectional shape and flow passage cross-sectional area to each other. The first drain-side individual flow passages 181 and the fourth drain-side individual flow passages 184 are formed with widths which are greater than those of the nozzle communicating passages 16 in the first direction X. This makes it possible to suppress increases in flow passage resistance of the drain-side individual flow passages 18 to reduce defects in drainage of ink and defects in discharge of ink droplets due to increases in flow passage resistance.

As illustrated in FIG. 10, the first drain-side individual flow passages 181 and the fourth drain-side individual flow passages 184, which communicate with the same row of nozzles 21 and which are different in orientation from the nozzles 21 in the in-plane directions of the nozzle surface 20*a*, are repeatedly arranged in the first direction X in which the drain-side individual flow passages 18 are placed side by side. In the present embodiment, the first drain-side individual flow passages 181 and the fourth drain-side individual flow passages 184 are alternately arranged one by one in the first direction X. It should be noted that the repeated arrangement of the first drain-side individual flow passages 181 and the fourth drain-side individual flow passages 184 in the first direction X encompasses an alternate arrangement of two or more of these first drain-side individual flow passages 181 and two or more of these fourth drain-side individual flow passages 184, i.e. an alternate arrangement of a first group of two or more first drain-side individual flow passages 181 successively placed side by side and a second group of two or more fourth drain-side individual flow passages 184 successively placed side by side.

In this way, drain-side individual flow passages 18 communicating with the same row of nozzles 21 are constituted by first drain-side individual flow passages 181 and fourth drain-side individual flow passages 184 that are different in orientation from the nozzles 21 in the in-plane directions of the nozzle surface 20*a* and the first drain-side individual flow passages 181 and the fourth drain-side individual flow passages 184 are alternately and repeatedly arranged one by one in the first direction X, whereby the second partition walls that separate the drain-side individual flow passages 18 from one another can be made thicker than first partition walls that separate the supply-side individual flow passages from one another.

The second partition walls here refer to partition walls that separate drain-side individual flow passages 18 adjacent to one another in the first direction X from one another and also refer to parts that overlap the drain-side individual flow passages 18 in the first direction X. That is, in the present embodiment, the second partition walls refer to a partition wall between two first drain-side individual flow passages 181 adjacent to each other in the first direction X and a partition wall between two fourth drain-side individual flow passages 184 adjacent to each other in the first direction X.

Further, the first partition walls, whose thicknesses are compared with those ones of the second partition walls and which separate the supply-side individual flow passages from one another, refer to the thinnest ones of those partition walls which separate the supply-side individual flow passages from one another. In the present embodiment, whose supply-side individual flow passages are the ink supply passages 13, the pressure generating chambers 12, and the nozzle communicating passages 16 as in the case of Embodiment 1, examples of the first partition walls include partition walls that separate the plurality of ink supply passages 13 from one another in the first direction X, the partition walls 11, which separate the plurality of pressure generating chambers 12 from one another in the first direction X, and partition walls that separate the plurality of nozzle communicating passages 16 from one another in the first direction X. In the present embodiment, whose ink supply passages 13 are formed by making the pressure generating chambers 12 narrower in width in the first direction X, the partition walls 11, which separate the pressure generating chambers 12 from one another, are thinner than the partition walls that separate the ink supply passages 13 from one another. Further, in the present embodiment, in which the nozzle communicating passages 16 are smaller in width in the first direction X than the pressure generating chamber 12, the partition walls 11, which separate the pressure generating chambers 12 from one another, are thinner than the partition walls that separate the nozzle communicating passages 16 from one another. Accordingly, in the present embodiment, the thinnest partition walls of the first partition walls are the partition walls 11, which separate the pressure generating chambers 12 from one another in the first direction X.

Moreover, in the present embodiment, as illustrated in FIG. 10, the first drain-side individual flow passages 181 and the forth drain-side individual flow passages 184, which are different in orientation from the nozzles 21 in the in-plane directions of the nozzle surfaces 20*a*, are alternately and repeatedly arranged one by one in the first direction X, whereby the thickness $d_{1B}$ of each of the second partition walls that separate the drain-side individual flow passages 18 from one another in the first direction X is greater than the thickness $d_2$ (see FIG. 5) of each of the partition walls 11 serving as the first partition walls that separate the pressure generating chambers 12 from one another, i.e. $d_{1B}>d_2$. Further, in the present embodiment, the first drain-side individual flow passages 181 and the fourth drain-side individual flow passages 184 are alternately and repeatedly arranged one by one in the first direction X, whereby the thickness $d_{1B}$ of each of the second partition walls that separate the drain-side individual flow passages 18 from one another in the first direction X is greater than the thickness $d_3$ (see FIG. 5) of each of the first partition walls that separate the nozzle communicating passages 16 from one another, i.e. $d_{1B}>d_3$.

By thus making the thickness $d_{1B}$ of each of the second partition walls that separate the drain-side individual flow passages 18 from one another greater than the thickness of each of the first partition walls that separate the supply-side individual flow passages from one another or, in the present embodiment, the thickness $d_2$ of each of the partition walls 11 that separate the pressure generating chambers 12 from one another and, furthermore, greater than the thickness $d_3$ of each of the partition walls that separate the nozzle communicating passages 16 from one another, the occurrence of structural crosstalk due to deficiencies in strength of the second partition walls is reduced, so that the occurrence of variations in discharge property, i.e. weight and discharge rate, of ink droplets can be reduced.

Further, since the area of bonding to the nozzle plate 20 can be increased by increasing the thickness $d_{1B}$ of each of the second partition walls that separate the drain-side individual flow passages 18 from one another, the occurrence of malfunctions such as defects in discharge of ink droplets caused by a loss of pressure due to leakage of ink and discharge of ink droplets from adjacent flow passages can be reduced by reducing leakage of ink between adjacent drain-side individual flow passages 18.

As described above, a recording head 1, which is a liquid ejecting head according to the present embodiment, includes a flow passage forming substrate 10, a protective substrate 30, a case member 40, a communicating plate 15, a nozzle plate 20, and a compliance substrate 45 serving as a flow passage member that includes a plurality of individual flow passages including nozzles 21 that eject ink serving as liquid and pressure generating chambers 12 that communicate with the nozzles 21, a supply-side common flow passage 41 through which to supply the ink to the plurality of individual flow passages, and a drain-side common flow passage 17 through which to drain the ink from the plurality of individual flow passages and piezoelectric actuators 300 serving as energy generating elements that effect pressure changes in the ink in the pressure generating chambers 12 to cause the ink to be discharged from the nozzles 21. The individual flow passages include ink supply passages 13, the pressure generating chambers 12, nozzle communicating passages 16, and the nozzles 21 as a plurality of supply-side individual flow passages between the supply-side common flow passage 41 and the nozzles 21 and a plurality of drain-side individual flow passages 18 between the nozzles 21 and the drain-side common flow passage 17. Second partition walls that separate the plurality of drain-side individual flow passages 18 from one another are thicker than first partition walls that separate the plurality of supply-side individual flow passages from one another.

By thus making the thickness $d_1$ of each of the second partition walls that separate the plurality of drain-side individual flow passages 18 from one another greater than the thickness $d_2$ of each of the first partition walls that separate the supply-side individual flow passages from one another or, in the present embodiment, each of partition walls 11 of the pressure generating chambers 12, the second partition wall is inhibited from deforming when a pressure change is effected only in one of the adjacent pressure generating chambers 12, so that the second partition wall can be inhibited from absorbing the pressure. Accordingly, by equalizing pressure changes in the pressure generating chambers 12 between the case of pressure changes simultaneously effected in both of the adjacent pressure generating chambers 12 and the case of a pressure change effected only in one of the pressure generating chambers 12, the occurrence of variations in discharge property, i.e. weight and discharge rate, of ink droplets can be reduced.

Further, by making the first partition walls smaller in thickness than the second partition walls, the supply-side individual flow passages can be densely arranged, so that the nozzles 21 can be densely arranged to achieve higher resolution.

Furthermore, by making the second partition walls greater in thickness than the first partition walls, the area of bonding between members forming the drain-side individual flow passages 18 can be increased. This makes it possible to improve bonding strength and to inhibit detachment of one member from another. Further, by increasing the thickness of each of the second partition walls between the drain-side individual flow passages 18, leakage of ink between drain-side individual flow passages 18 adjacent to each other can be reduced, so that defects in discharge can be reduced.

It should be noted that the clause "the second partition walls are thicker than the first partition walls" means that the second partition walls are thicker than the thinnest ones of the first partition walls. Accordingly, the first partition walls may include first partition walls that are thicker than the second partition walls, provided some of the first partition walls are thinner than the second partition walls.

Further, the recording head 1 according to the present embodiment may be configured such that the plurality of drain-side individual flow passages 18 include first drain-side individual flow passages 181 and fourth drain-side individual flow passages 184 as flow passages that are different in orientation from the nozzles 21 in directions including a first direction X and a second direction Y that are in-plane directions of a nozzle surface 20 on which the plurality of nozzles 21 are arranged. With this configuration, by using the first drain-side individual flow passages 181 and the fourth drain-side individual flow passages 184, which are different in orientation from the nozzles 21 in the in-plane directions of the nozzle surface 20*a*, as the drain-side individual flow passages 18, the second partition walls that separate the drain-side individual flow passages 18 from one another can be easily made greater in thickness and the drain-side individual flow passages 18 can be made larger in flow passage cross-sectional area, so that increases in flow passage resistance can be suppressed.

Further, a recording head 1 according to the present embodiment includes a flow passage forming substrate 10, a protective substrate 30, a case member 40, a communicating plate 15, a nozzle plate 20, and a compliance substrate 45 serving as a flow passage member that includes a plurality of individual flow passages including nozzles 21 that discharge ink serving as liquid and pressure generating chambers 12, a supply-side common flow passage 41 through which to supply the ink to the plurality of individual flow passages, and a drain-side common flow passage 17 through which to drain the ink from the plurality of individual flow passages and piezoelectric actuators 300 serving as energy generating elements that effect pressure changes in the ink in the pressure generating chambers 12 to cause the ink to be discharged from the nozzles 21. The individual flow passages include ink supply passages 13, the pressure generating chambers 12, nozzle communicating passages 16, and the nozzles 21 as a plurality of supply-side individual flow passages between the supply-side common flow passage 41 and the nozzles 21 and a plurality of drain-side individual flow passages 18 between the nozzles 21 and the drain-side common flow passage 17. The plurality of drain-side individual flow passages 18 include first drain-side individual flow passages 181 and fourth drain-side individual flow passages 184 as flow passages that are different in orientation from the nozzles 21 in directions including a first direction X and a second direction Y that are in-plane directions of a nozzle surface 20 on which the plurality of nozzles 21 are arranged.

By thus using the first drain-side individual flow passages 181 and the fourth drain-side individual flow passages 184, which are different in orientation from the nozzles 21 in the in-plane direction of the nozzle surface 20*a*, as the drain-side individual flow passages 18, the second partition walls that separate the drain-side individual flow passages 18 from one another can be easily made greater in thickness and the drain-side individual flow passages 18 can be made larger in flow passage cross-sectional area, so that increases in flow passage resistance can be suppressed.

Further, by making the second partition walls greater in thickness, the area of bonding between members forming the drain-side individual flow passages 18 can be increased. This makes it possible to improve bonding strength and to inhibit detachment of one member from another. Further, by increasing the thickness of each of the second partition walls that separate the drain-side individual flow passages 18 from one another, leakage of ink between drain-side individual flow passages 18 adjacent to each other can be reduced, so that defects in discharge can be reduced.

It should be noted that the second partition walls that separate the drain-side individual flow passages 18 from one another include partition walls that are thinner than the first partition walls that separate the plurality of supply-side individual flow passages from one another.

Further, the recording head 1 according to the present embodiment may be configured such that the drain-side common flow passage 17 includes first drain-side common flow passages 171 and a second drain-side common flow passage 172 between which the plurality of nozzles 21 are interposed in directions including the first direction X and the second direction Y, which are in-plane directions. By thus providing the first drain-side common flow passages 171 and the second drain-side common flow passage 172, between which the plurality of nozzles 21 are interposed, the first drain-side individual flow passages 181 and the fourth drain-side individual flow passages 184, which are different in orientation from the nozzles 21, can be easily provided so as to communicate with the drain-side common flow passage 17.

Further, the recording head 1 according to the present embodiment may be configured such that the pressure generating chambers 12 placed side by side form two rows and that the drain-side common flow passage 17 is provided between the two rows of pressure generating chambers 12. This configuration eliminates the need for second drain-side common flow passages 172 for each separate row of pressure generating chambers 12 by causing the second drain-side common flow passage 172 of the drain-side common flow passage 17 to communicate with the two rows of pressure generating chambers 12 in common. This makes it possible to save a space in which to provide the second drain-side common flow passage 172, thus making it possible to achieve a reduction in size of the communicating plate 15.

Further, the recording head 1 according to the present embodiment may be configured such that of the plurality of drain-side individual flow passages 18, the first drain-side individual flow passages 181, which are flow passages that communicate with the first drain-side individual flow passages 171, and the fourth drain-side individual flow passages 184, which are flow passages that communicate with the second drain-side individual flow passage 172, are repeatedly arranged in the first direction X in which the plurality of drain-side individual flow passages 18 are placed side by side. The repeated arrangement of the first drain-side individual flow passages 181 and the fourth drain-side individual flow passages 184 in the first direction X makes it possible to make each of the second partition walls that separate the drain-side individual flow passages 18 from one another comparatively great in thickness and to give the second partition walls a regularity of thickness, thus making it possible to reduce variations in strength of the second partition walls.

Incidentally, the repeated arrangement of the first drain-side individual flow passages 181 and the fourth drain-side individual flow passages 184 in the first direction X encompasses an alternate arrangement of one of these first drain-side individual flow passages 181 and one of these fourth drain-side individual flow passages 184 and an alternate arrangement of two or more of these first drain-side individual flow passages 181 and two or more of these fourth drain-side individual flow passages 184. In either case, a regularly repeated arrangement makes it possible to increase the thickness of each of the second partition walls that separate the drain-side individual flow passages 18 from one another and give the plurality of second partition walls a regularity of thickness, thus making it possible to reduce variations in strength of the second partition walls. In particular, an alternate arrangement of one of these first drain-side individual flow passages 181 and one of these fourth drain-side individual flow passages 184 makes it easy to make the plurality of second partition walls that separate the drain-side individual flow passages 18 from one another uniform in thickness, thus making it possible to further reduce variations in strength of the second partition walls.

Further, the recording head 1 according to the present embodiment may be configured such that each of the drain-side individual flow passages 18 is smaller in width than in height as seen from a direction of flow of the drain-side individual flow passage 18. This configuration makes it possible to make each of the second partition walls that separate the drain-side individual flow passages 18 from one another comparatively great in thickness and to suppress increases in flow passage resistance by making the drain-side individual flow passages 18 comparatively large in flow passage cross-sectional area. Of course, the drain-side individual flow passages 18 may be greater in width than in height.

The drain-side individual flow passages 18 according to Embodiment 1 described above that are different in distance from the nozzle surface 20*a* in the third direction Z may be applied to the first drain-side individual flow passages 181 extended toward the first side of the second direction Y and the fourth drain-side individual flow passages 184 extended toward the second side of the second direction Y. That is, although, in the present embodiment, the first drain-side individual flow passages 181 are provided as drain-side individual flow passages 18 that connect the nozzle communicating passages 16 to the first drain-side common flow passages 171, this is not intended to impose any particular limitation. For example, the second drain-side individual flow passages 182 or third drain-side individual flow passages 183 described above may be provided. That is, the drain-side individual flow passages 18 that connect the nozzle communicating passages 16 to the first drain-side common flow passages 171 may include flow passages that are different in distance from the nozzle surface 20*a* in the third direction Z. Further, similarly, the fourth drain-side individual flow passages 184, which connect the nozzle communicating passages 16 to the second drain-side common flow passage 172, may be provided in the same positions as the second drain-side individual flow passages 182, i.e. between the first communicating plate 151 and the second communicating plate 152, or may be provided in the same positions as the third drain-side individual flow passages 183, i.e. between the first communicating plate 151 and the third communicating plate 153. That is, the drain-side individual flow passages 18 that connect the nozzle communicating passages 16 to the second drain-side common flow passage 172 may include flow passages that are different in distance from the nozzle surface 20*a* in the third direction Z. This makes it possible to further increase the thickness of a second partition wall of drain-side individual flow passages 18 adjacent to each other in the first direction X. This makes it possible to reduce the occurrence of structural crosstalk of the second partition wall and to reduce the occurrence of structural crosstalk by increasing the cross-sectional areas of the drain-side individual flow passages 18 for reduction of flow passage resistance.

Further, although, in the present embodiment, by providing the first drain-side individual flow passages 181 and the fourth drain-side individual flow passages 184 as the drain-side individual flow passages 18, the thickness $d_{1B}$ of each of the second partition walls that separate the drain-side individual flow passages 18 from one another is made greater than the thickness of each of the thinnest ones of the first partition walls that separate the supply-side individual flow passages from one another, i.e. the partition walls that separate the ink supply passages 13 from one another, the partition walls 11 that separate the pressure generating chambers 12 from one another, and the partition walls that separate that the nozzle communicating passages 16 from one another as in the case of Embodiment 1 described above. However, this is not intended to impose any particular limitation. When first drain-side individual flow passages 181 and fourth drain-side individual flow passages 184 that are different in drawing direction in the in-plane directions of the nozzle surface 20*a*, the thickness $d_{1A}$ of each of the second partition walls may be equal to or smaller than the thickness of each of the first partition walls. That is, in the present embodiment, since the thinnest ones of the first partition walls are the partition walls 11 of the pressure generating chambers 12, the thickness $d_{1A}$ of each of the second partition walls may be equal to or smaller than the thickness $d_2$ of each of the partition walls 11, i.e. $d_{1A}$ $d_2$. By thus providing the first drain-side individual flow passages 181 and the fourth drain-side individual flow passages 184 as the drain-side individual flow passages 18, a large space in which the drain-side individual flow passages 18 can be provided is secured, and by providing the drain-side individual flow passages 18 with comparatively large flow passage cross-sectional areas in this space, drainage properties can be improved with reduced flow passage resistance of the drain-side individual flow passages 18.

Figure 13:
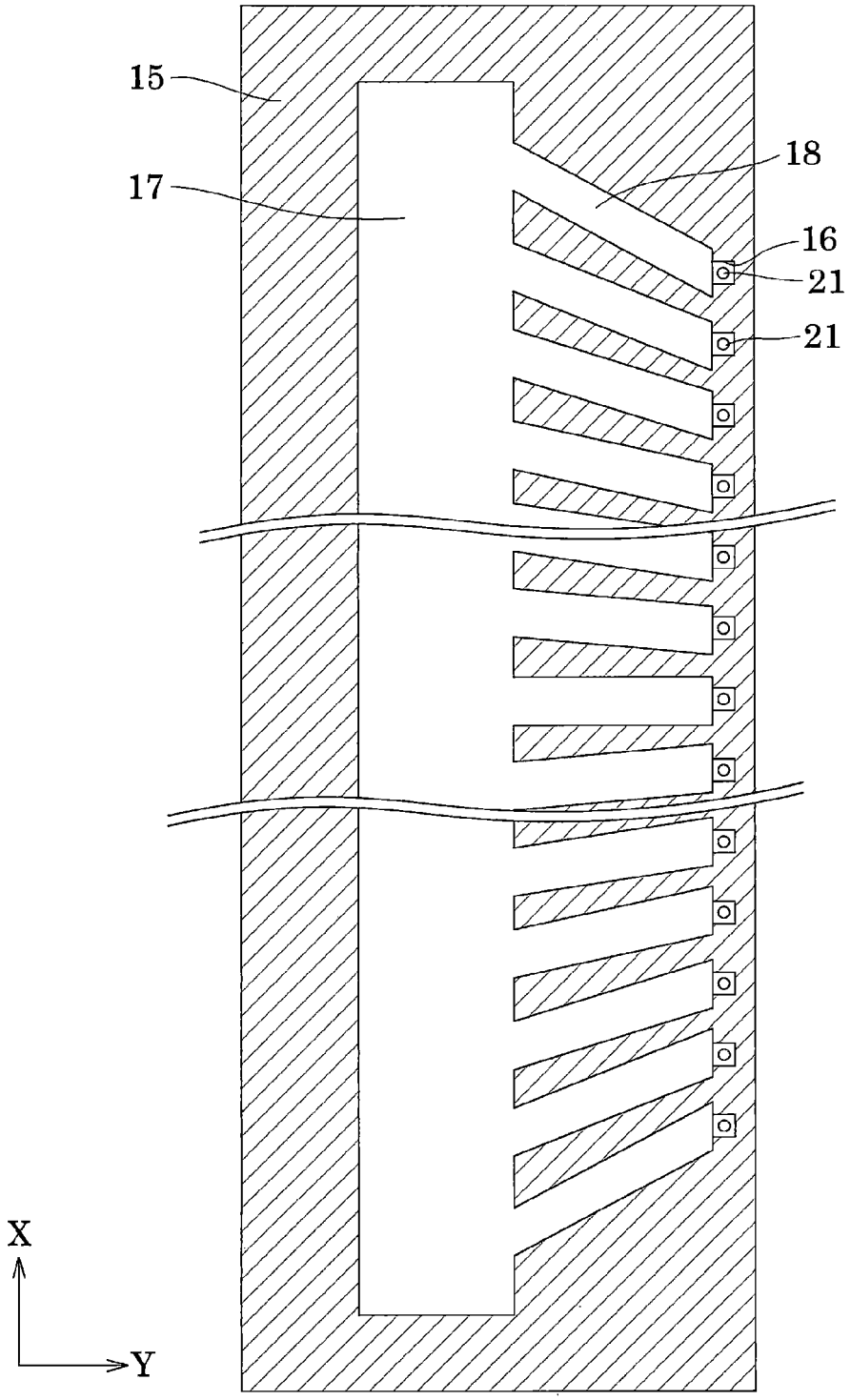
FIG. 13 is a cross-sectional view illustrating a modification of the recording head according to Embodiment 2.

Further, in the present embodiment, the first drain-side individual flow passages 181 and the fourth drain-side individual flow passages 184, which are different in direction along the second direction Y, are provided as drain-side individual flow passages 18 that are different in direction from the nozzles 21 in directions including the first direction X and the second direction Y, which are the in-plane directions of the nozzle surface 20*a*, this is not intended to impose any particular limitation. For example, as illustrated in FIG. 13, the plurality of drain-side individual flow passages 18 may be provided so as to radially extend toward the drain-side common flow passage 17. Even in such a configuration, it can be said that the plurality of drain-side individual flow passages 18 are different in direction from the nozzles 21 in directions including the first direction X and the second direction Y, which are the in-plane directions of the nozzle surface 20*a*. Further, when the plurality of drain-side individual flow passages 18 are provided so as to radially extend as illustrated in FIG. 13, the second partition walls that separate the plurality of drain-side individual flow passages 18 from one another gradually become thicker from the nozzle communicating passages 16 toward the drain-side common flow passage 17. This makes it possible to suppress structural crosstalk by improving the rigidity of the second partition walls and to reduce leakage of ink between adjacent drain-side individual flow passages 18 and the like by increasing the area of bonding between the second partition walls that separate adjacent drain-side individual flow passages 18 and the nozzle plate 20.

Other Embodiments

While embodiments of the present disclosure have been described above, the present disclosure is not limited in basic configuration to the embodiments descried above.

For example, although, in each of the embodiments descried above, each nozzle 21 is provided with one drain-side individual flow passage 18, this is not intended to impose any particular limitation. Each nozzle 21 may be provided with two or more drain-side individual flow passages 18.

Figure 14:
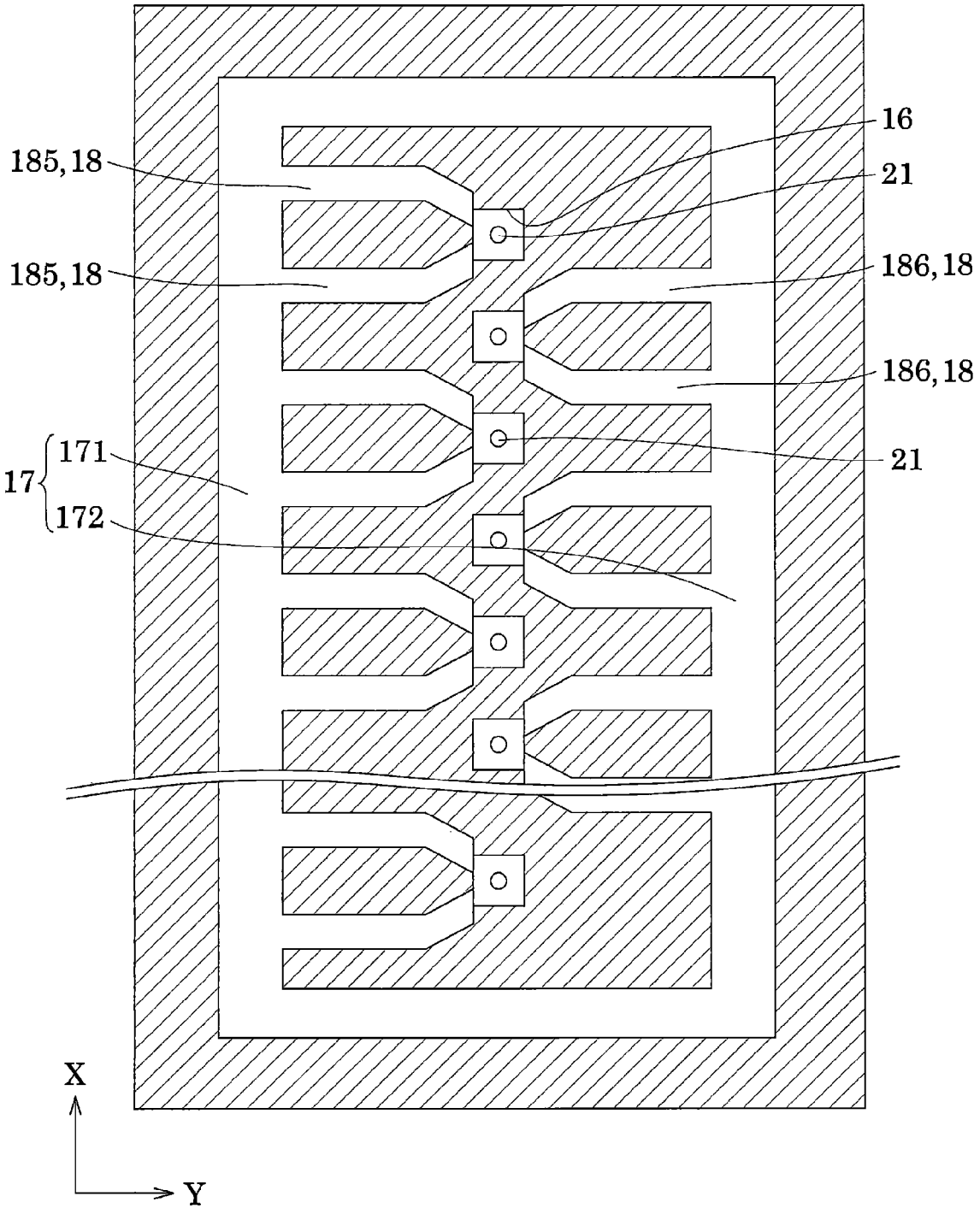
FIG. 14 is a cross-sectional view illustrating a modification of the recording head according to Embodiment 2.

Such an example is illustrated in FIG. 14. FIG. 14 is a diagram illustrating a modification of Embodiment 2 described above.

As illustrated in FIG. 14, each nozzle 21 is provided with two drain-side individual flow passages 18. Specifically, the drain-side individual flow passages 18 include a fifth drain-side individual flow passage 185 that communicates with the first drain-side common flow passage 171 and a sixth drain-side individual flow passage 186 that communicates with the second drain-side common flow passage 172, and the fifth drain-side individual flow passage 185 and the sixth drain-side individual flow passage 186 are different in orientation from the nozzle 21 in the in-plane directions of the nozzle surface 20*a*.

Each nozzle 21 is provided with two fifth drain-side individual flow passages 185 placed side by side in the first direction X. Further, a width in the first direction X of each of the fifth drain-side individual flow passages 185 placed side by side in the first direction X for each nozzle 21 is greater beside the first drain-side common flow passage 171 than beside the nozzle communicating passage 16.

Similarly, each nozzle 21 is provided with two sixth drain-side individual flow passages 186 placed side by side in the first direction X. Further, a width in the first direction X of each of the sixth drain-side individual flow passages 186 placed side by side in the first direction X for each nozzle 21 is greater beside the second drain-side common flow passage 172 than beside the nozzle communicating passage 16.

By thus providing each nozzle 21 with a plurality of drain-side individual flow passages 18, the rigidity of the second partition wall that separate the drain-side individual flow passages 18 from one another can be improved so that structural crosstalk is easily reduced, as compared with a case in which each nozzle 21 is provided with one drain-side individual flow passage 18 with the same flow passage cross-sectional area.

As illustrated in FIG. 14, which illustrates a modification of Embodiment 2 described above, each nozzle 21 may be similarly provided with two or more drain-side individual flow passages 18 in Embodiment 1 described above, too.

Further, for example, although, in each of the embodiments described above, the first drain-side individual flow passages 181 are formed by covering, with the nozzle plate 20, recesses provided in the second communicating plate 152, this is not intended to impose any particular limitation. For example, the first drain-side individual flow passages 181 may be formed by providing recesses in the nozzle plate 20 and covering these recesses with the second communicating plate 152, or the first drain-side individual flow passages 181 may be formed by providing recesses in both the second communicating plate 152 and the nozzle plate 20 and joining openings of the recesses to each other. Further, although, in the present embodiment, the first drain-side individual flow passages 181 are provided at the joint interface between the communicating plate 15 and the nozzle plate 20, this is not intended to impose any particular limitation. A member that is joined to the communicating plate 15 is not limited to the nozzle plate 20 but may for example be a different member such as the compliance substrate 45, and the first drain-side individual flow passages 181 may be provided at the joint interface between the communicating plate 15 and the different member.

Further, although, in each of the embodiments described above, the compliance substrate 45 is provided on a side of the case member 40 opposite to the flow passage forming substrate 10 in the third direction Z, this is not intended to impose any particular limitation. For example, the compliance substrate 45 does not need to be provided, or the compliance substrate 45 may be provided on a side surface of the case member 40 such as a surface of the case member 40 that extends along a direction perpendicular to the nozzle surface 20*a*.

Further, although, in each of the embodiments described above, the nozzles 21 are arranged in a linear arrangement along the first direction X, this is not intended to impose any particular limitation. For example, the nozzles 21 may be arranged in a staggered arrangement in which a first nozzle row of nozzles 21 placed side by side in the first direction X and a second nozzle row of nozzles 21 placed side by side in the first direction X are placed side by side in the second direction Y and the first nozzle row and the second nozzle row are displaced from each other in the first direction X so as not to be in the same position in the second direction Y.

Furthermore, although each of the embodiments described above has illustrated, as a flow passage member, one including the flow passage forming substrate 10, the communicating plate 15, the nozzle plate 20, the protective substrate 30, the case member 40, and the compliance substrate 45, this is not intended to impose any particular limitation. The flow passage member may include one member or may include two or more members.

Furthermore, although each of the embodiments described above has illustrated a configuration in which the pressure generating chambers 12 of the individual flow passages are located upstream from the nozzles 21, i.e. beside the supply-side common flow passages 41, this is not intended to impose any particular limitation. The pressure generating chambers 12 may be located downstream from the nozzles 21, i.e. beside the drain-side common flow passage 17.

Further, although each of the embodiments described above has illustrated a configuration in which the thickness $d_2$ of each of the partition walls 11 that separate the pressure generating chambers 12 from one another is smaller than the thickness $d_3$ of each of the partition walls that separate the nozzle communicating passages 16 from one another, this is not intended to impose any particular limitation. The thickness $d_2$ of each of the partition walls 11 may be equal to or greater than the thickness $d_3$ of each of the partition walls that separate the nozzle communicating passages 16 from one another. In this case, the thickness $d_1$ or $d_{1A}$ of each of the second partition walls that separate the drain-side individual flow passages 18 from one another needs only be greater than at least the thickness $d_3$ of each of the partition walls that separate the nozzle communicating passages 16 from one another.

Further, although each of the embodiments described above has been described by using thin-film piezoelectric actuators 300 as energy generating elements that effect pressure changes in the pressure generating chambers 12, this is not intended to impose any particular limitation. Usable examples of energy generating elements include a thick-film piezoelectric actuator that is formed by a method such as green sheet pasting and a longitudinal-vibration piezoelectric actuator in which alternate layers of piezoelectric material and electrode forming material axially expand and contract. Further, usable examples of energy generating elements include a heater element, placed in a pressure generating chamber, that generates heat to produce bubbles that cause liquid droplets to be discharged from a nozzle and a so-called electrostatic actuator that generates static electricity between a vibrating plate and an electrode to deform the vibrating plate by electrostatic force to cause liquid droplets to be discharged from a nozzle.

Figure 15:
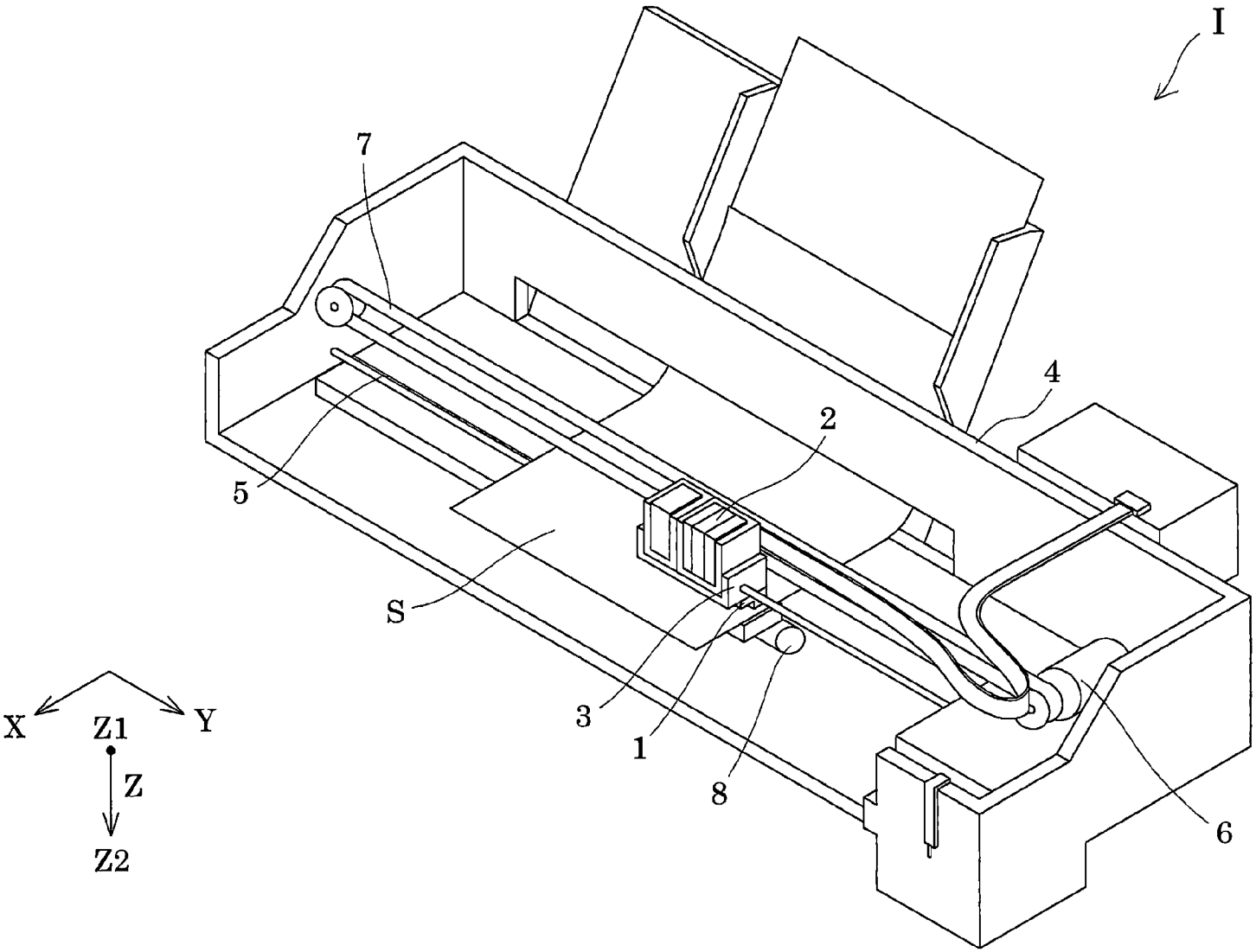
FIG. 15 is a schematic view of a recording apparatus according to an embodiment.

Further, a recording head 1 according to each of these embodiments is mounted on an ink jet recording apparatus that is an example of a liquid ejecting apparatus. FIG. 15 is a schematic view illustrating an example of an ink jet recording apparatus.

In an ink jet recording apparatus I illustrated in FIG. 15, a plurality of ink jet recording heads 1 are detachably provided with a cartridge 2 that constitutes an ink supply unit, and a carriage 3 mounted with these recording heads 1 is axially movably provided on a carriage shaft 5 attached to an apparatus body 4.

Moreover, the carriage 3 mounted with the recording heads 1 is moved along the carriage shaft 5 by transmitting a driving force of a driving motor 6 to the carriage 3 through a plurality of gears (not illustrated) and a timing belt 7. Meanwhile, the apparatus body 4 is provided with a transporting roller 8 serving as a transporting unit so that a recording sheet S serving as a recording medium such as paper is transported by the transporting roller 8. The transporting unit that transports the recording sheet S is not limited to the transporting roller 8 but may be a belt, a drum, or the like.

Although the ink jet recording apparatus I described above has illustrated an example in which the recording heads 1 are mounted on the carriage 3 and move in a main scanning direction, this is not intended to impose any particular limitation. For example, the present disclosure is also applicable to a so-called line recording apparatus that performs printing by simply moving a recording sheet S such as paper in a subscanning direction with a recording head 1 fixed.

Furthermore, the present disclosure is intended for a wide range of liquid ejecting heads in general and also applicable, for example, to recording heads such as various types of ink jet recording head for use in image recording apparatuses such as printers, color material ejecting heads for use in manufacture of color filters of liquid crystal displays and the like, electrode material ejecting heads for use in formation of electrodes of organic EL displays, FEDs (field emission displays), and the like, bioorganic substance ejecting heads for use in biochip manufacture, and the like.

What is claimed is:

1. A liquid ejecting head comprising:

a nozzle surface having a plurality of nozzles that discharge liquid in a first axial direction;

a plurality of individual flow passages provided for each separate one of the nozzles and placed side by side along a second axial direction orthogonal to the first axial direction;

a plurality of pressure generating chambers configured to supply the liquid to the plurality of nozzles;

a supply-side common flow passage through which to supply the liquid to the plurality of individual flow passages in common; and a drain-side common flow passage through which to recover liquid drained from the plurality of individual flow passages in common, wherein the plurality of individual flow passages include a plurality of supply-side individual flow passages between the supply-side common flow passage and the nozzles and a plurality of drain-side individual flow passages between the nozzles and the drain-side common flow passage, adjacent ones of the supply-side individual flow passages of the individual flow passages are separated from each other by a first partition wall, adjacent ones of the drain-side individual flow passages at a same position in the first axial direction of the individual flow passages are separated from each other by a second partition wall, the second partition wall is thicker than the first partition wall, and the plurality of drain-side individual flow passages include flow passages that are different in distance from the nozzle surface in a direction orthogonal to the nozzle surface, the plurality of nozzles being arranged on the nozzle surface.

2. The liquid ejecting head according to claim 1, wherein the second partition wall is thicker than a partition wall that separates the plurality of pressure generating chambers from each other.

3. A liquid ejecting apparatus comprising the liquid ejecting head according to claim 1.

4. A liquid ejecting head comprising:

a nozzle surface having a plurality of nozzles that discharge liquid in a first axial direction;

a plurality of individual flow passages provided for each separate one of the nozzles and placed side by side along a second axial direction orthogonal to the first axial direction;

a plurality of pressure generating chambers configured to supply the liquid to the plurality of nozzles;

a supply-side common flow passage through which to supply the liquid to the plurality of individual flow passages in common; and a drain-side common flow passage through which to recover liquid drained from the plurality of individual flow passages in common, wherein the plurality of individual flow passages include a plurality of supply-side individual flow passages between the supply-side common flow passage and the nozzles and a plurality of drain-side individual flow passages between the nozzles and the drain-side common flow passage, adjacent ones of the supply-side individual flow passages of the individual flow passages are separated from each other by a first partition wall, adjacent ones of the drain-side individual flow passages at a same position in the first axial direction of the individual flow passages are separated from each other by a second partition wall, and the second partition wall is thicker than the first partition wall, a flow passage member includes a plurality of communicating passages between the nozzles and pressure generating chambers, and the second partition wall is thicker than a partition wall that separates the plurality of communicating passages from each other.

5. A liquid ejecting head comprising:

a nozzle surface having a plurality of nozzles that discharge liquid in a first axial direction;

a plurality of individual flow passages provided for each separate one of the nozzles and placed side by side along a second axial direction orthogonal to the first axial direction;

a plurality of pressure generating chambers configured to supply the liquid to the plurality of nozzles;

a supply-side common flow passage through which to supply the liquid to the plurality of individual flow passages in common; and a drain-side common flow passage through which to recover liquid drained from the plurality of individual flow passages in common, wherein the plurality of individual flow passages include a plurality of supply-side individual flow passages between the supply-side common flow passage and the nozzles and a plurality of drain-side individual flow passages between the nozzles and the drain-side common flow passage, adjacent ones of the supply-side individual flow passages of the individual flow passages are separated from each other by a first partition wall, adjacent ones of the drain-side individual flow passages at a same position in the first axial direction of the individual flow passages are separated from each other by a second partition wall, the second partition wall is thicker than the first partition wall, and the nozzles are each provided with a plurality of the drain-side individual flow passages.

6. A liquid ejecting head comprising:

a nozzle surface having a plurality of nozzles that discharge liquid in a first axial direction;

a plurality of individual flow passages provided for each separate one of the nozzles and placed side by side along a second axial direction orthogonal to the first axial direction;

a plurality of pressure generating chambers configured to supply the liquid to the plurality of nozzles;

a supply-side common flow passage through which to supply the liquid to the plurality of individual flow passages in common; and a drain-side common flow passage through which to recover liquid drained from the plurality of individual flow passages in common, wherein the plurality of individual flow passages include a plurality of supply-side individual flow passages between the supply-side common flow passage and the nozzles and a plurality of drain-side individual flow passages between the nozzles and the drain-side common flow passage, adjacent ones of the supply-side individual flow passages of the individual flow passages are separated from each other by a first partition wall, adjacent ones of the drain-side individual flow passages at a same position in the first axial direction of the individual flow passages are separated from each other by a second partition wall, the second partition wall is thicker than the first partition wall, and the drain-side individual flow passages are smaller in width dimension than in height dimension in cross-section perpendicular to a direction of flow.

* * * * *